US009080498B2

(12) United States Patent
Rez

(10) Patent No.: US 9,080,498 B2
(45) Date of Patent: Jul. 14, 2015

(54) COMBUSTION ENGINE WITH A PAIR OF ONE-WAY CLUTCHES USED AS A ROTARY SHAFT

(71) Applicant: Mustafa Rez, Covina, CA (US)

(72) Inventor: Mustafa Rez, Covina, CA (US)

( * ) Notice: Subject to any disclaimer, the term of this patent is extended or adjusted under 35 U.S.C. 154(b) by 78 days.

(21) Appl. No.: 14/090,948

(22) Filed: Nov. 26, 2013

(65) Prior Publication Data

US 2014/0083378 A1 Mar. 27, 2014

Related U.S. Application Data

(63) Continuation-in-part of application No. 13/444,139, filed on Apr. 11, 2012, now abandoned.

(51) Int. Cl.

| | |
|---|---|
| ***F02B 75/32*** | (2006.01) |
| ***F01P 1/04*** | (2006.01) |
| ***F01P 3/10*** | (2006.01) |
| ***F02B 63/06*** | (2006.01) |
| ***F01B 9/04*** | (2006.01) |
| ***F01B 9/08*** | (2006.01) |
| ***F02B 33/22*** | (2006.01) |

(52) U.S. Cl.

CPC . *F01P 1/04* (2013.01); *F01B 9/047* (2013.01); *F01B 9/08* (2013.01); *F01P 3/10* (2013.01); *F02B 33/22* (2013.01); *F02B 63/06* (2013.01); *F02B 75/32* (2013.01)

(58) Field of Classification Search

CPC ..... F01B 9/047; F01B 9/08; F02B 75/32; F02B 63/06; F01P 1/04; F01P 3/10

USPC ..... 123/197.1–197.5, 41.37

See application file for complete search history.

(56) References Cited

U.S. PATENT DOCUMENTS

| | | | | |
|---|---|---|---|---|
| 385,226 | A | 6/1888 | Barden | |
| 1,045,505 | A | 11/1912 | Brauer | |
| 1,122,972 | A | 12/1914 | Maye | |
| 1,374,164 | A | 4/1921 | Nordwick | |
| 1,419,693 | A | 6/1922 | Schultz | |
| 1,528,164 | A | 3/1925 | Nordwick | |
| 1,654,378 | A | 12/1927 | Marchetti | |
| 1,828,060 | A | 10/1931 | Michael | |
| 2,261,086 | A | 10/1941 | Hunt | |
| 3,267,917 | A * | 8/1966 | Bargero | 123/53.4 |
| 3,517,652 | A | 6/1970 | Albertson | |
| 3,584,610 | A | 6/1971 | Porter | |
| 3,820,337 | A | 6/1974 | Martin | |
| 4,003,351 | A | 1/1977 | Gunther | |
| 4,013,048 | A | 3/1977 | Reitz | |

(Continued)

FOREIGN PATENT DOCUMENTS

| | | |
|---|---|---|
| WO | WO9849434 | 11/1998 |

*Primary Examiner* — Marguerite McMahon

(74) *Attorney, Agent, or Firm* — Kirk A. Buhler; Buhler & Associates

(57) ABSTRACT

Improvements in a combustion engine performance and reduced temperature of the combustion engine therefore resulting in an increase in the brake thermal efficiency where the pistons move linearly within the combustion cylinder. A pair of one-way clutches is used to convert the reciprocating linear motion into rotary motion without a crank shaft and without friction or power loss in the engine. High pressure oil is used to intercool the piston and the cylinder walls and is used for lubricating the piston ring. This configuration will improve the engine efficiency and reduce emission and result in a low cost engine.

18 Claims, 23 Drawing Sheets

(56) References Cited

U.S. PATENT DOCUMENTS

| | | | | |
|---|---|---|---|---|
| 4,097,198 | A | 6/1978 | Herron | |
| 4,459,945 | A | 7/1984 | Chatfield | |
| 4,480,599 | A | 11/1984 | Allais | |
| 4,545,336 | A | 10/1985 | Waide | |
| 4,907,548 | A | 3/1990 | Lee | |
| 4,945,725 | A | 8/1990 | Carmein | |
| 5,673,665 | A * | 10/1997 | Kim | 123/197.1 |
| 5,791,303 | A | 8/1998 | Skripov | |
| 6,397,722 | B1 | 6/2002 | Eddington | |
| 6,904,888 | B1 * | 6/2005 | Heifets | 123/197.1 |
| 6,976,467 | B2 | 12/2005 | Fantuzzi | |
| 7,121,236 | B2 | 10/2006 | Scuderi | |
| 7,475,666 | B2 | 1/2009 | Heimbecker | |
| 8,074,619 | B2 | 12/2011 | Harju | |
| 8,281,763 | B2 | 10/2012 | Namikoshi | |
| 2001/0017122 | A1 | 8/2001 | Fantuzzi | |
| 2008/0121196 | A1 | 5/2008 | Fantuzzi | |
| 2009/0314252 | A1 * | 12/2009 | Perewusnyk | 123/25 P |
| 2010/0275884 | A1 | 11/2010 | Gary, Jr. | |
| 2010/0294232 | A1 * | 11/2010 | Otterstrom | 123/197.1 |
| 2011/0146629 | A1 | 6/2011 | Radocaj | |
| 2012/0090571 | A1 | 4/2012 | Namikoshi | |

* cited by examiner

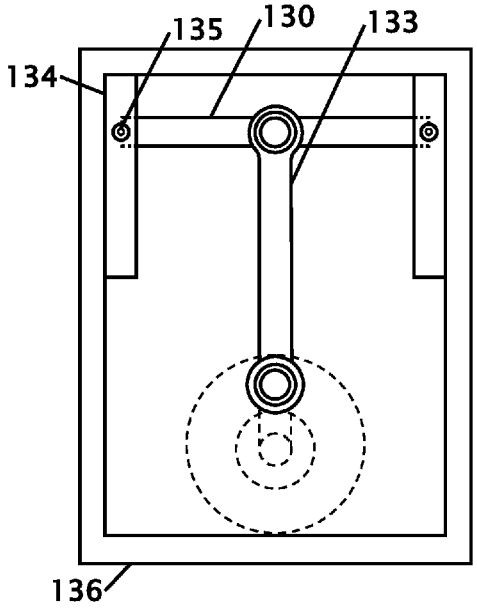
FIG. 13
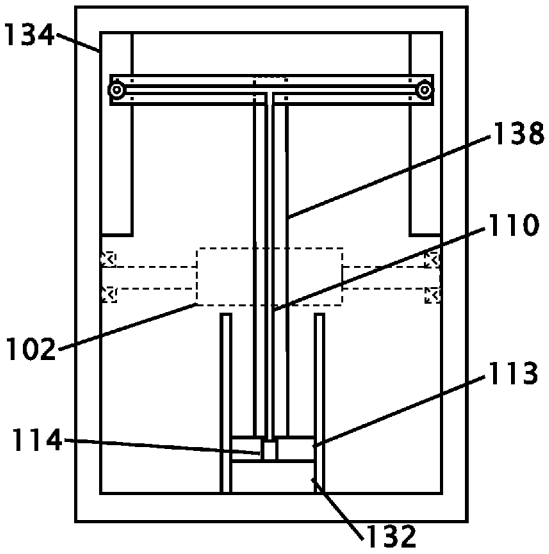
FIG. 14
FIG. 15
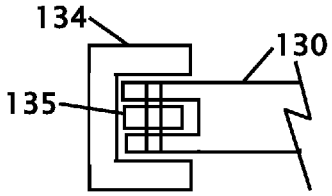

COMBUSTION ENGINE WITH A PAIR OF ONE-WAY CLUTCHES USED AS A ROTARY SHAFT

CROSS REFERENCE TO RELATED APPLICATION

This application is a continuation-in-part of applicant's co-pending application Ser. No. 13/444,139 filed Apr. 11, 2012, and PCT application PCT/US12/038088 filed on May 16, 2012 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in an internal combustion engine. More particularly, the engine uses light weight pistons and where the piston moves linearly in the combustion cylinder that eliminates friction and side forces of the piston and eliminates the crankshaft.

2. Description of Related Art Including Information Disclosed Under 37 CFR 1.97 and 1.98

A number of patents and or publications have been made to address these issues. Exemplary examples of patents and or publication that try to address this/these problem(s) are identified and discussed below.

When the internal combustion engine is used as a four cycle engine with four cylinders where it uses four combustion units, each unit has a compressing combustion cylinder and a hydraulic cylinder where each piston of the two cylinders moves linearly and uses a gear and a pair of one-way clutches to extract the majority of the power to the output shaft, furthermore, a small crank shaft is used and the size of the crank shaft as much one quarter of the mass of an average crank shaft that would be used in a conventional combustion engine of similar displacement. This crankshaft operates the camshaft for exhaust and intake valves and for starting of the engine. The high pressure oil is used for intercooling the piston and the cylinder.

U.S. Pat. No. 3,584,610 issued Jun. 15, 1971 to Kilburn I. Porter discloses a radial internal combustion engine with pairs of diametrically opposed cylinders. While the piston arms exist in a fixed orientation to the pistons the volume under the pistons is not used to pump air into the intake stroke of the engine.

U.S. Pat. No. 4,459,945 issued Jul. 17, 1984 to Glen F. Chatfield discloses a cam controlled reciprocating piston device. One or opposing two or four pistons operates from special cams or yokes that replace the crankpins and connecting rods. While this patent discloses piston arms that are fixed to the pistons there also is no disclosure for using the area under each piston to move air into the intake stroke of the piston.

U.S. Pat. No. 4,480,599 issued Nov. 6, 1984 to Egidio Allais discloses a free-piston engine with operatively independent cam. The pistons work on opposite sides of the cam to balance the motion of the pistons. Followers on the cam move the pistons in the cylinders. The reciprocating motion of the pistons and connecting rod moves a ferric mass through a coil to generate electricity as opposed to rotary motion. The movement of air under the pistons also is not used to push air into the cylinders in the intake stroke.

U.S. Pat. No. 8,104,436 issued Jan. 31, 2012 to Gray Jr. Charles L. discloses a free-piston engine with the combustion engine that is couples to a hydraulic piston to produce hydraulic power that is used outside of the engine. High pressure oil is used in the hydraulic motor to extract the power that is created by the engine.

BRIEF SUMMARY OF THE INVENTION

It is an object of the engine to eliminate the side forces of the piston engine on the cylinder wall thereby reducing the friction of the engine.

It is an object of the engine to use a pair of one-way clutched and gears to convert the reciprocating linear motion of the pistons into rotary motion without side forces in the piston engine and crankshaft friction. The power in the piston will be nearly completely transferred to an output shaft, as compared to a conventional crankshaft where the power transfer is less than 65% of the power and compared to a free piston engine the power will transfer less than 70%.

It is an object of the engine to eliminate the complicated crankshaft and for this design to be less expensive.

It is an object of the engine to use a hydraulic piston in a hydraulic cylinder where the piston maintains linear movement of the combustion piston. The high pressure oil is used to intercooling the combustion piston and the intercooling of the combustion engine through the combustion walls and the lubrication of the piston rings; part of the high pressure oil is used in the radiator for cooling the oil. Where the high pressure oil that is not used to extract the engine power as most of the free piston engine.

Where the free piston is needed the motor to convert the hydraulic linear motion to rotational motion and makes more energy loss when compared to this engine design.

It is an object of the engine when it is used as a split cycle engine, two-combustion units and two compressor units. The combustion units are compressing, a combustion cylinder and a hydraulic cylinder and automatic exhaust valves that are controlled by the combustion piston and differential pressure of the hydraulic cylinder and no outside control and where the compressor units are compressing a compressor cylinder and it can be a larger size than the combustion cylinder for self-supercharging the combustion cylinder and where the air inlet valve is controlled by differential pressure of the hydraulic cylinder.

It is another object of the engine for when the internal combustion engine is used as a split cycle engine with a dual chamber cylinder engine for the engine to work as two cylinder units—four cycle engine where the cylinder unit compressing the upper cylinders are for a dual chamber cylinder and where the lower cylinder is used for a hydraulic cylinder and where the dual chamber use the upper chamber for as a combustion chamber and the lower chamber as for a compressor chamber. The engine comprises at least two cylinder units and where each unit is connected to each other with a gear shaft or a pair of one-way clutches by a piston gear rod. A small crank shaft is used for starting the engine and as an output shaft and where the exhaust valves and intake valves are operated by high pressure oil by using the hydraulic piston valve. This engine is automatically controlled by pressurized oil in the hydraulic cylinder in the engine and therefore does not need any adjustment or computer control, and where automatic mechanical fuel injector is used.

It is still another object of the engine to be the smallest and the most efficient and less expensive engine ever built.

It is still another object of the engine to reduce the heat temperature of the combustion cylinder by reducing the friction of the piston on the cylinder wall by using high pressure oil and this can lead the engine working at a lower temperature for combustion (LTC) and this is helpful for reducing engine output of nitrogen oxide (NOx) emissions, thereby reducing the need to consume additional fuel for exhaust after treatment and the crankshaft will reduce fuel consumption and reduce emissions. Reference: Report on the transportation combustion engine efficiency colloquium held at UScar, Mar. 3-4 2010 by Oak Ridge National Laboratory, Department of Energy.

It is another object of the engine for the engine to be use high pressure oil to intercool the piston and the cylinder walls. This can eliminate the need for exhaust gas recirculation (EGR) and eliminate the need for a water pump, and for an oil pump.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 6:
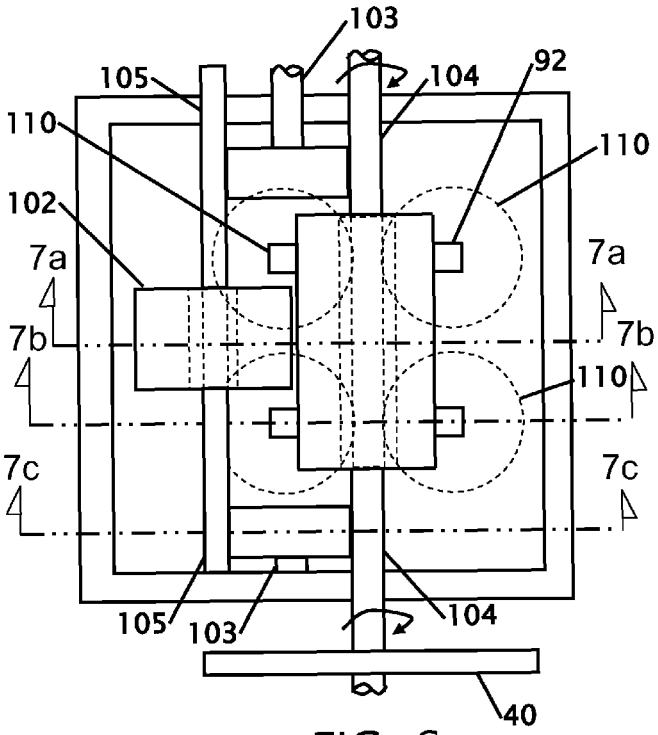
FIG. 6 shows a four cylinder engine with a pair of one-way clutches and one gear.
Figure 7B:
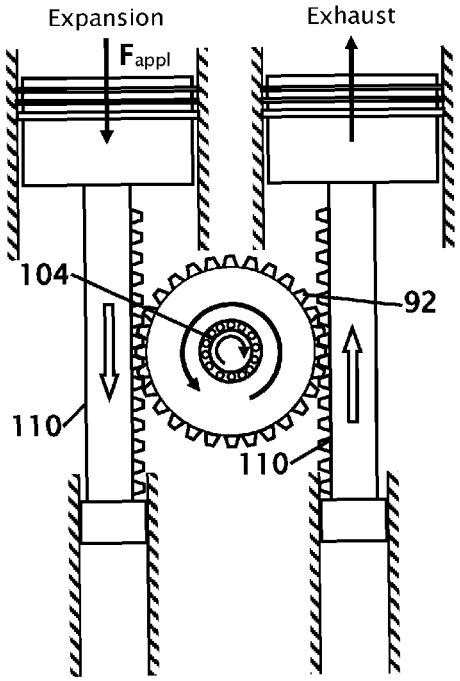
Figure 7A:
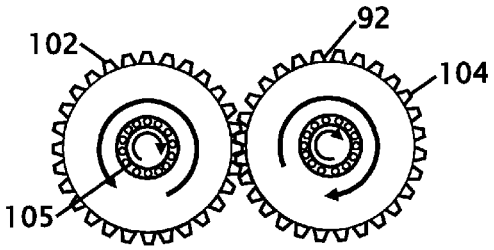

FIG. 7*a* shows a cross-sectional view cut through 7*a*-7*a* of FIG. 6 for a one-way clutches.

FIG. 7*b* shows a cross sectional view cut through 7*b*-7*b* of FIG. 6.

Figure 7C:
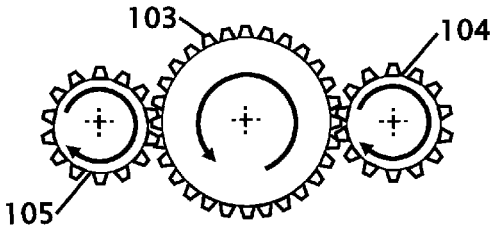

FIG. 7*c* shows a cross sectional view cut through 7*c*-7*c* of FIG. 6.

Figure 8:
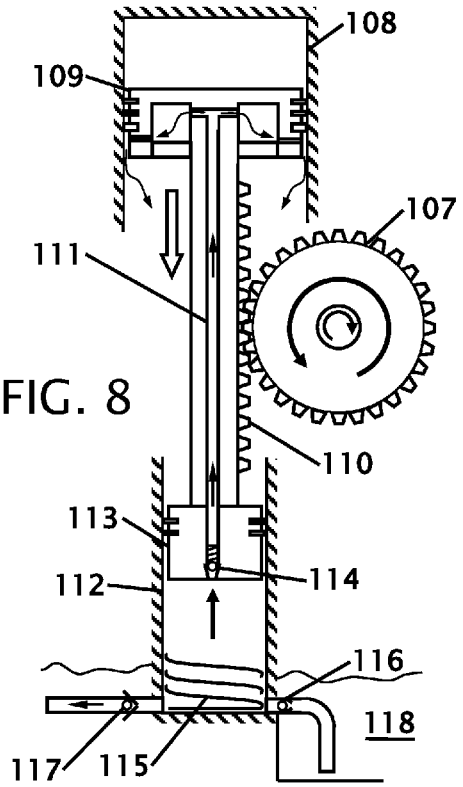

FIG. 8 shows a combustion cylinder where the combustion piston moves linearly with the hydraulic piston.

Figure 9:
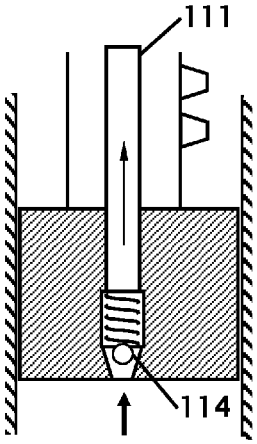

FIG. 9 shows the hydraulic piston with a one-way valve.

Figure 10A:
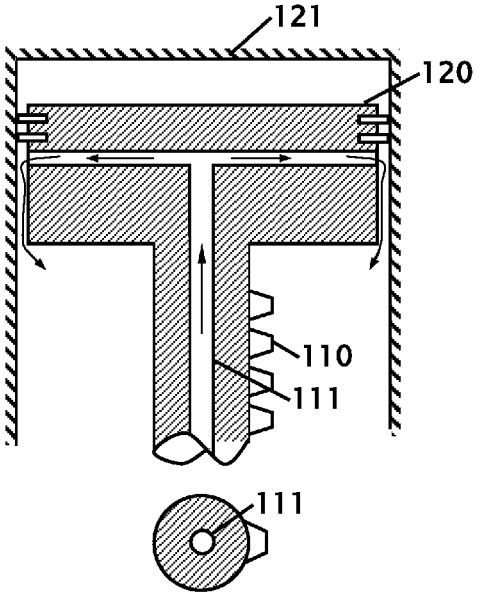

FIG. 10*a* shows a detail for the oil being pushed through the body of the combustion piston.

Figure 10B:
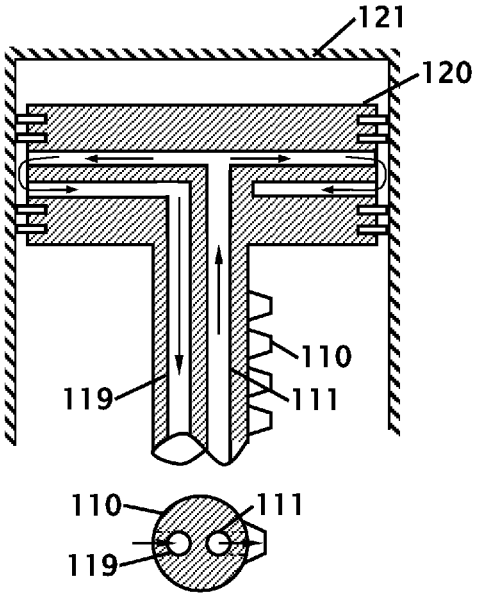

FIG. 10*b* shows a detail for the oil being pushed through the body of the dual chamber piston.

Figure 11:
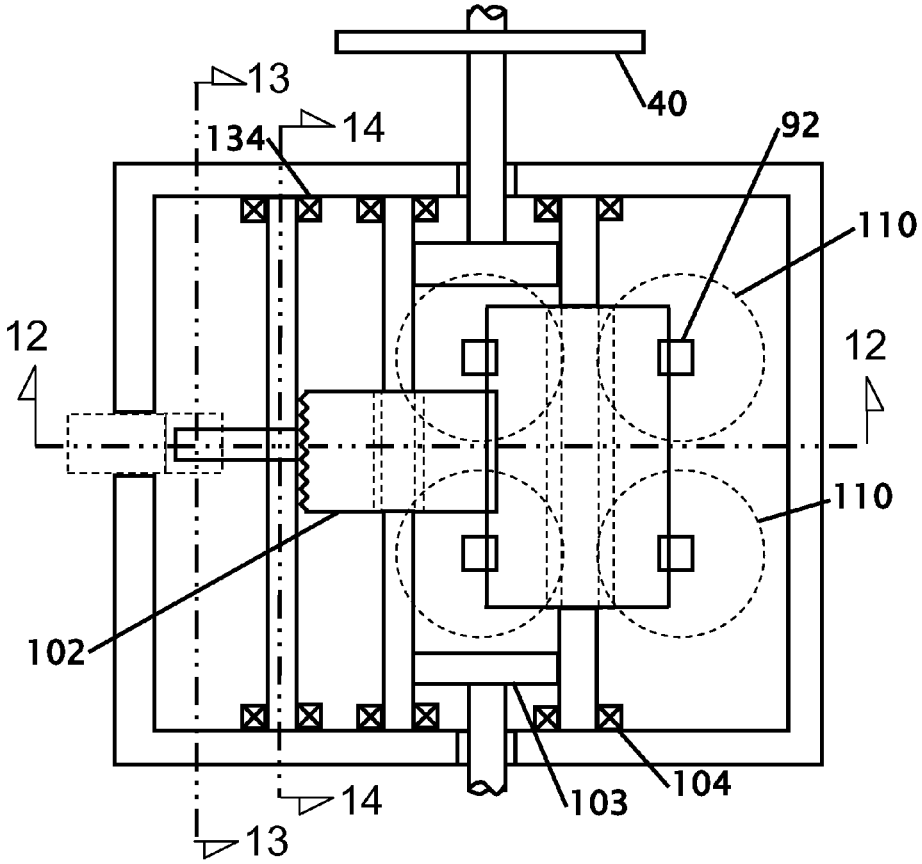

FIG. 11 shows a four cylinder engine where the engine comprises of four combustion units using a pair of one-way clutches.

Figure 12:
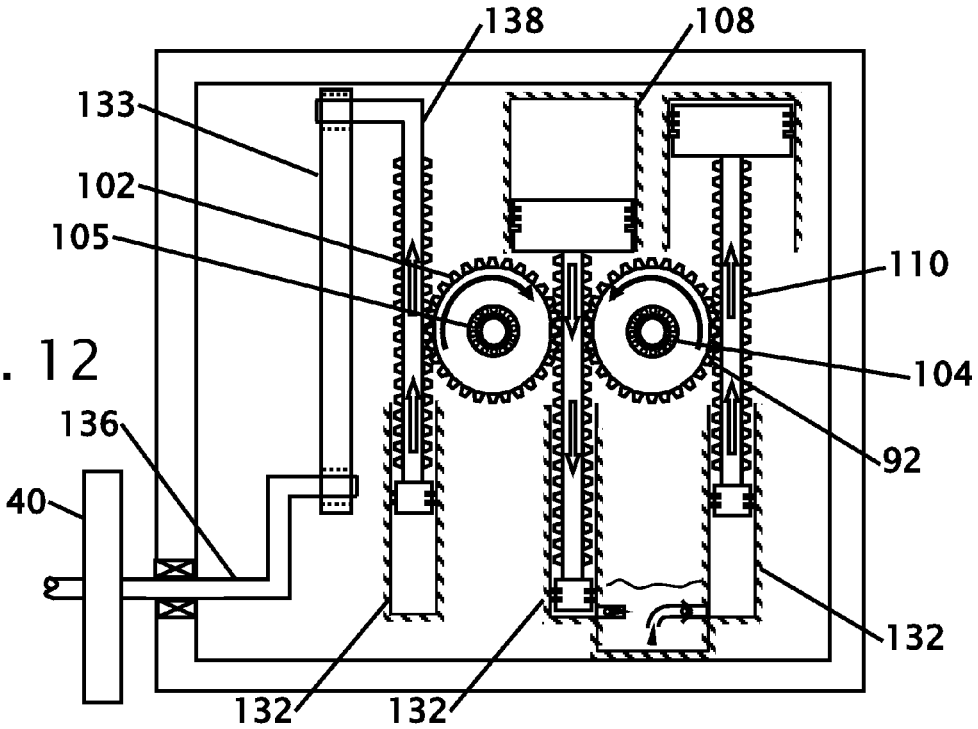

FIG. 12 shows a cross sectional view cut through 12-12 of FIG. 11.

FIG. 13 shows a cross sectional view cut through 13-13 of FIGS. 11, 16, 18, 20 and 22.

FIG. 14 shows a cross sectional view cut through 14-14 of FIGS. 11, 16, 18, 20 and 22.

FIG. 15 shows a detail view of the rail and bearings for the crankshaft.

Figure 16:
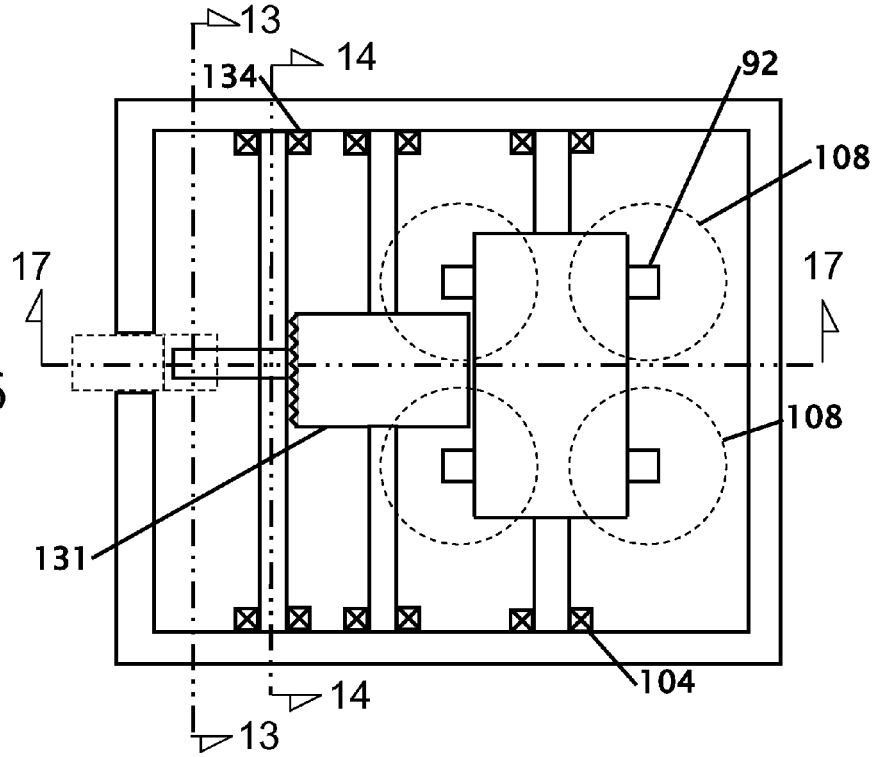

FIG. 16 shows a four cylinder engine with a two gear shaft and a crankshaft.

Figure 17:
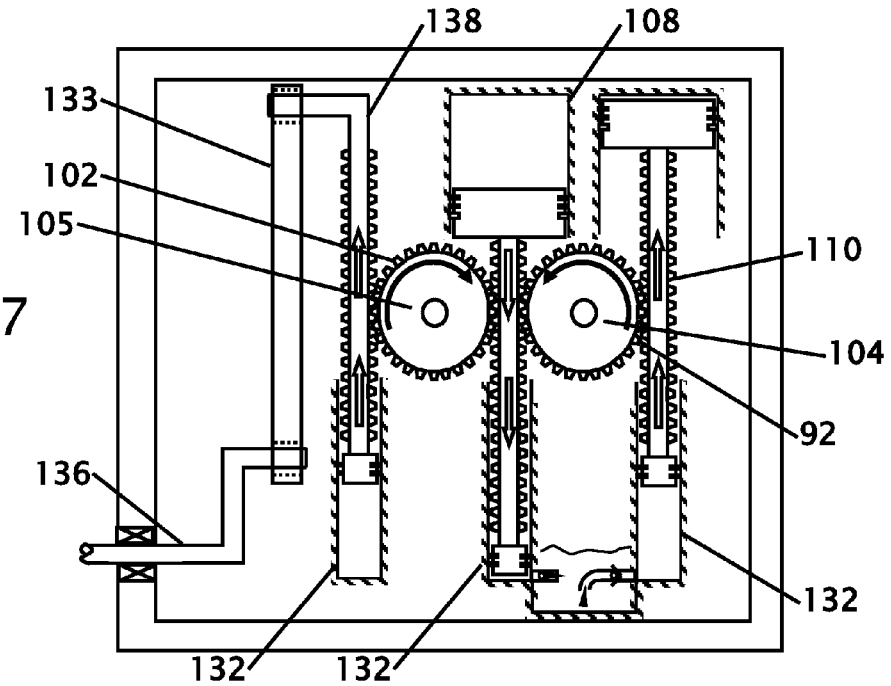

FIG. 17 shows a cross sectional view cut through 17-17 of FIG. 16.

Figure 18:
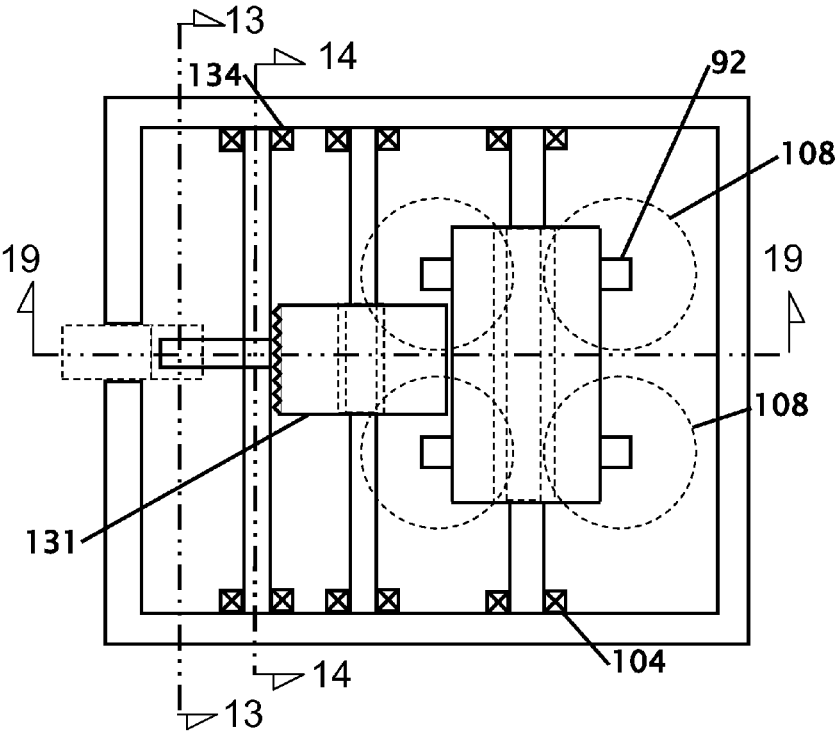

FIG. 18 shows eight combustion cylinders without using a hydraulic cylinder and using a pair of one-way clutches.

Figure 19:
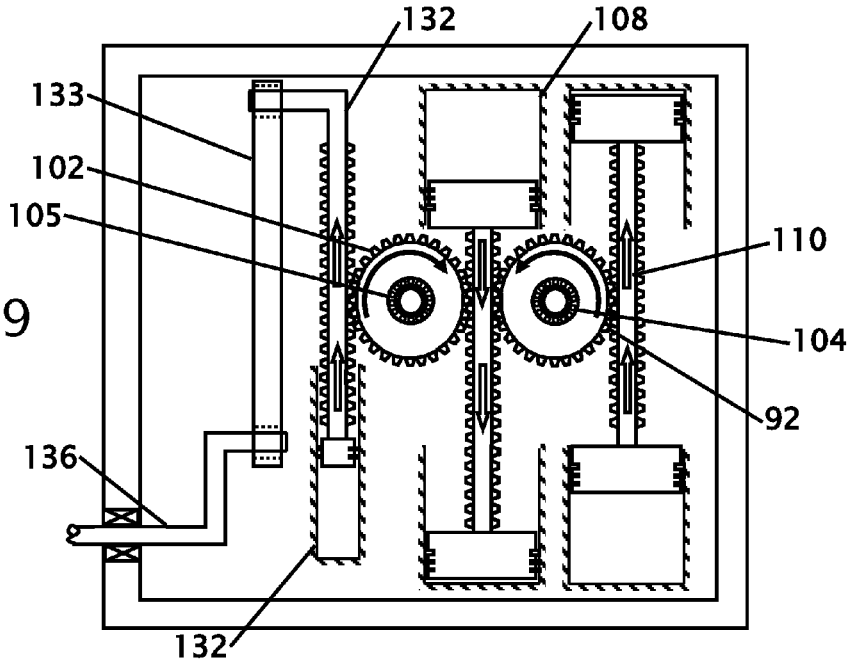

FIG. 19 shows a cross-sectional view cut through 19-19 of FIG. 18.

Figure 20:
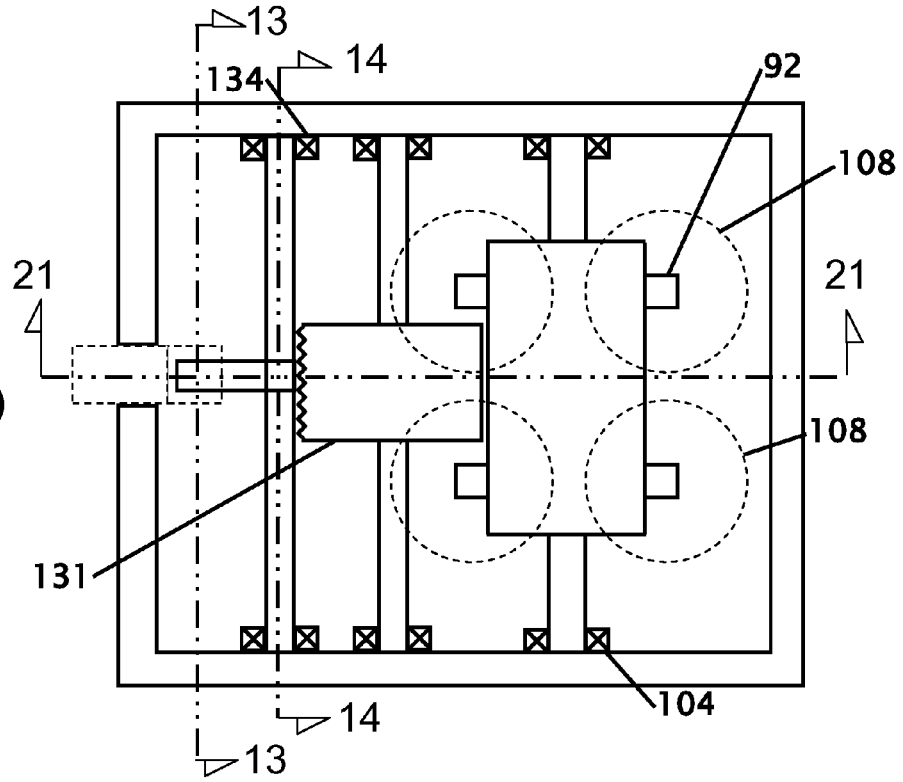

FIG. 20 shows an eight combustion cylinder without using a hydraulic cylinder and using one gear shaft and one crankshaft.

Figure 21:
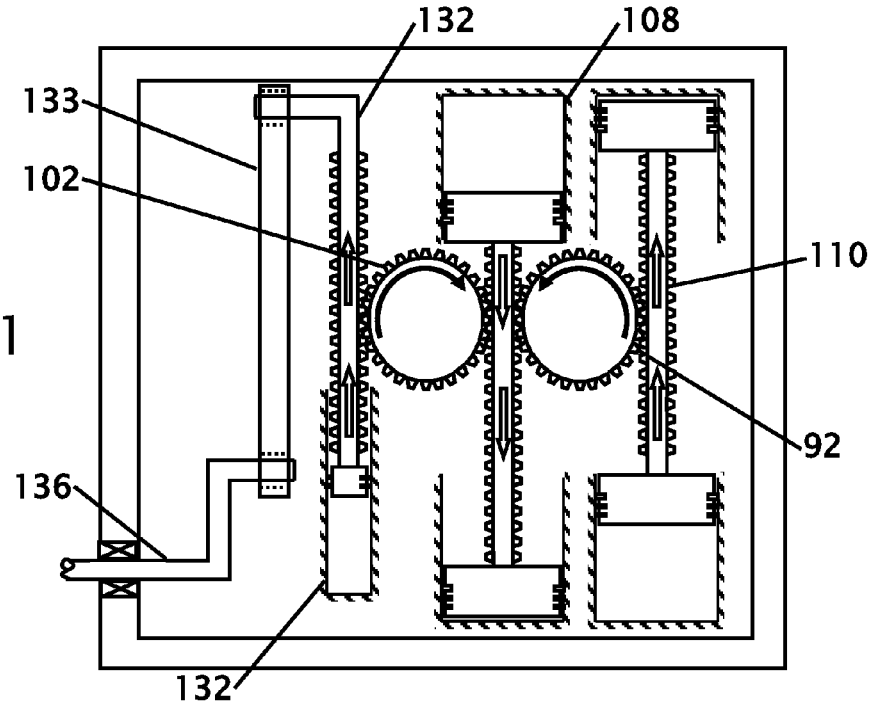

FIG. 21 shows a cross-sectional view cut through 21-21 of FIG. 20.

Figure 22:
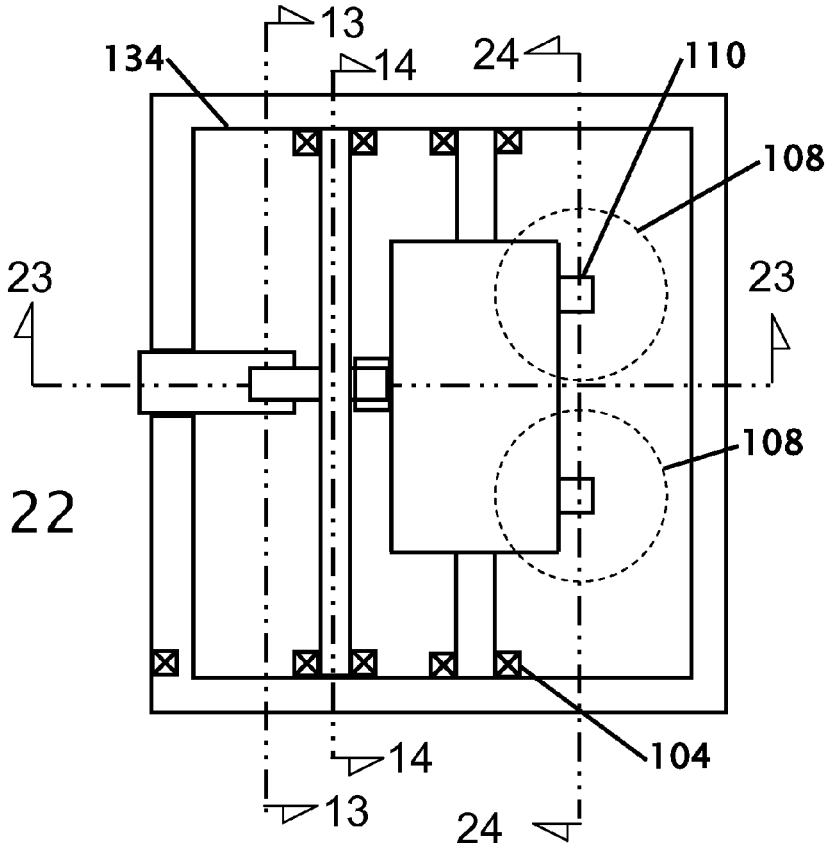

FIG. 22 shows a four cylinder engine as a two combustion engine on one side using a one gear shaft.

Figure 23:
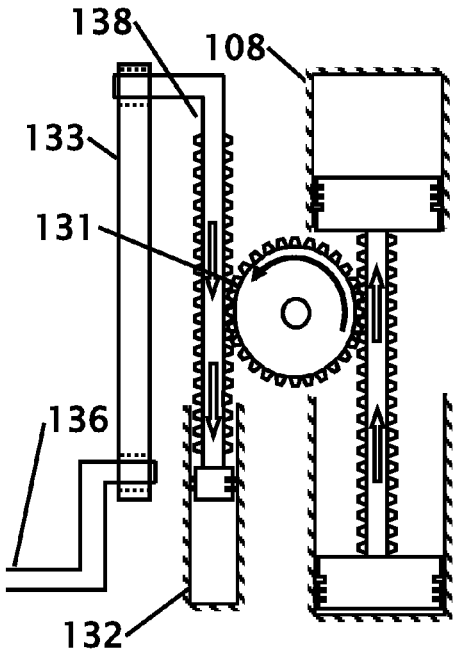

FIG. 23 shows a cross sectional view cut through 23-23 of FIG. 22.

Figure 24:
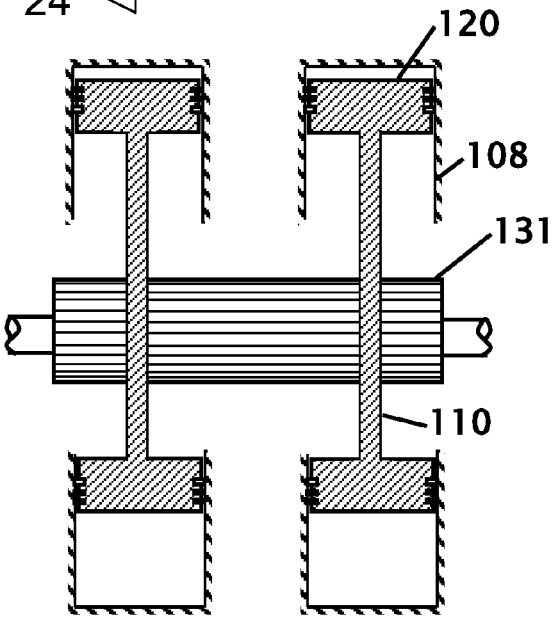

FIG. 24 shows a cross sectional view cut through 24-24 of FIG. 22.

Figure 25:
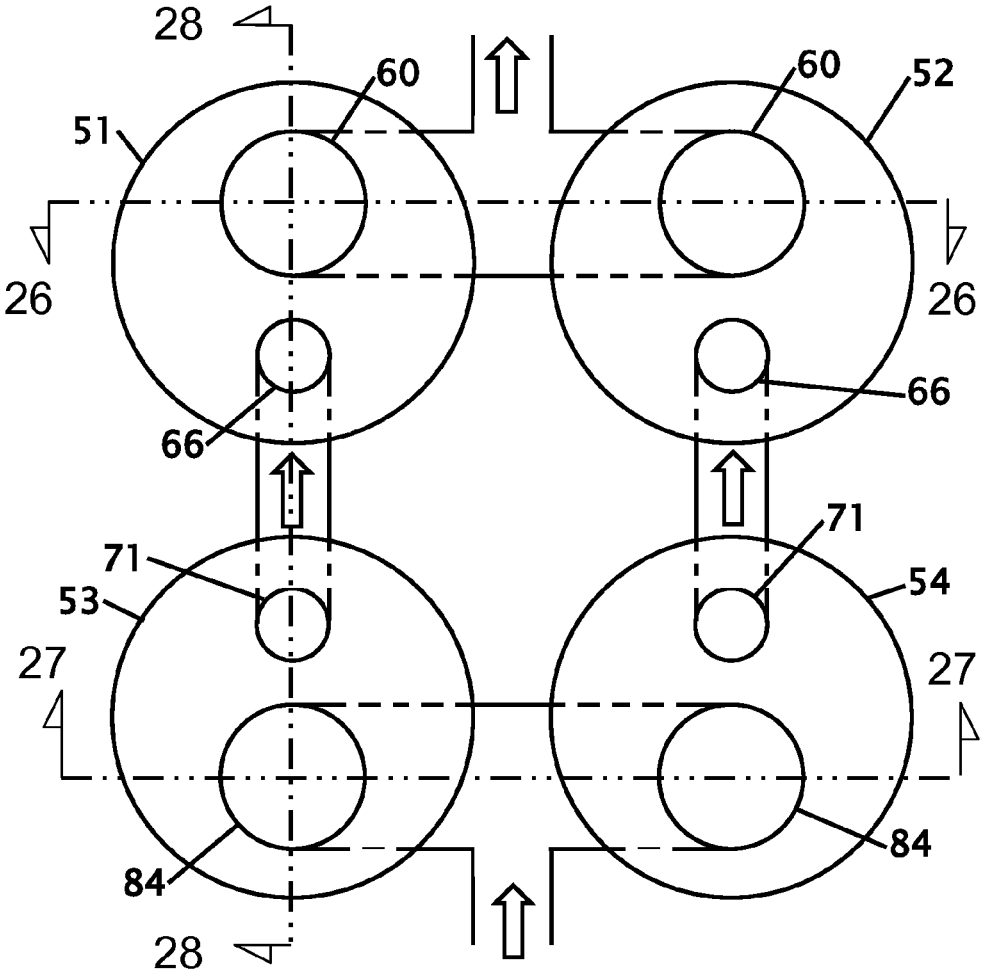

FIG. 25 shows a split cycle engine with two combustion cylinders and two compressor cylinders.

Figure 26:
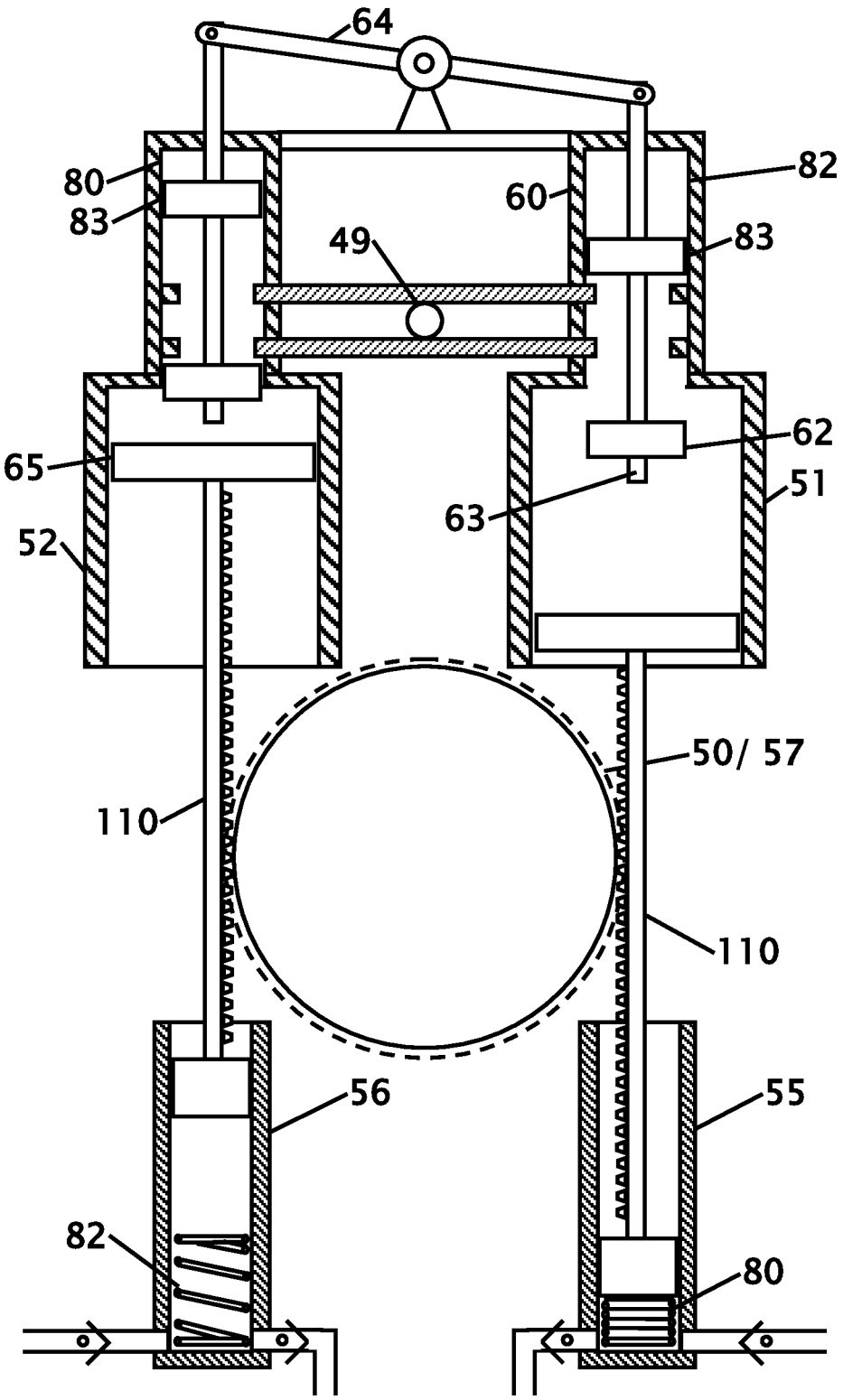

FIG. 26 shows a cross sectional view cut through 26-26 of FIG. 25.

Figure 27:
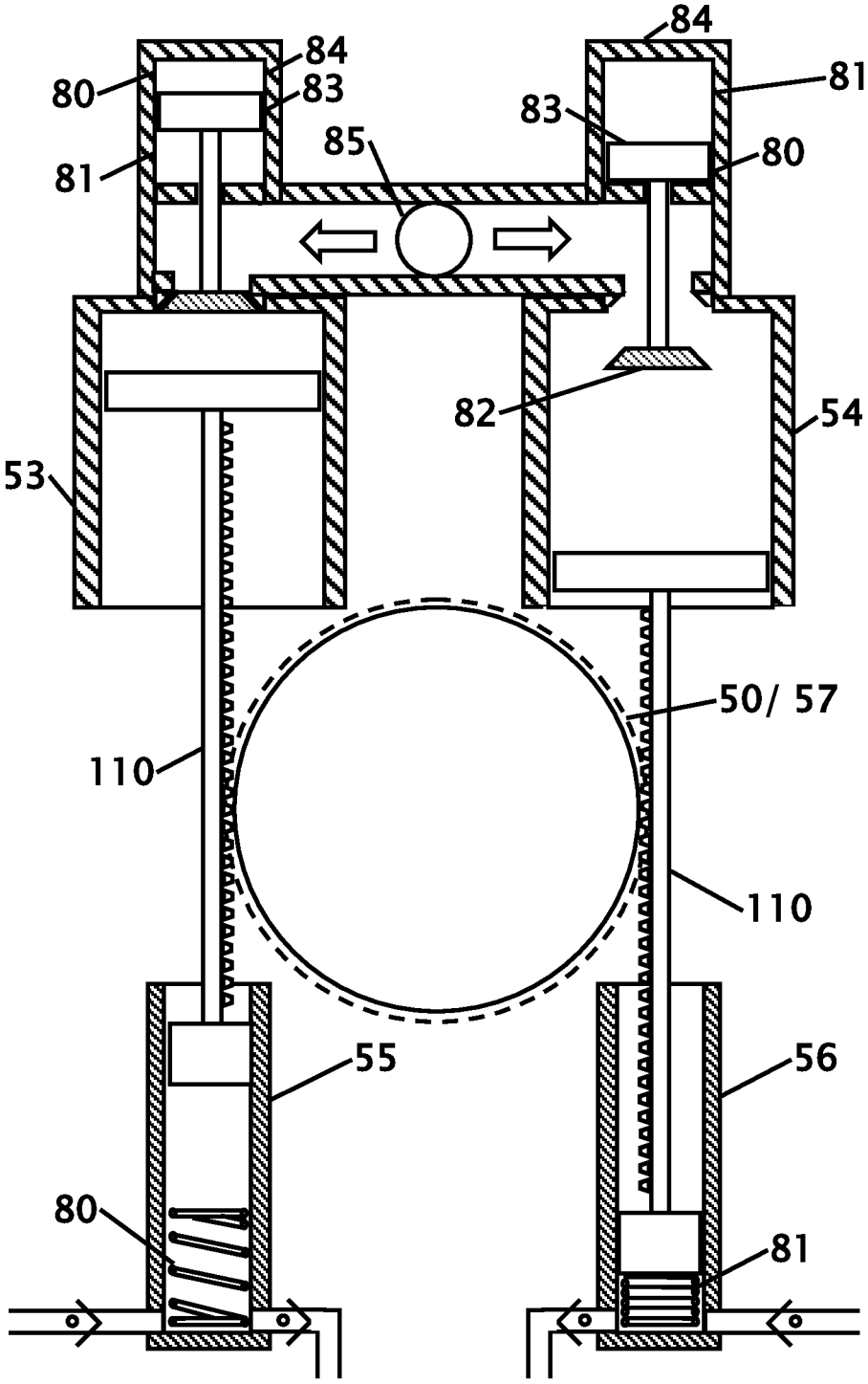

FIG. 27 shows a cross sectional view cut through 27-27 of FIG. 25.

Figure 28:
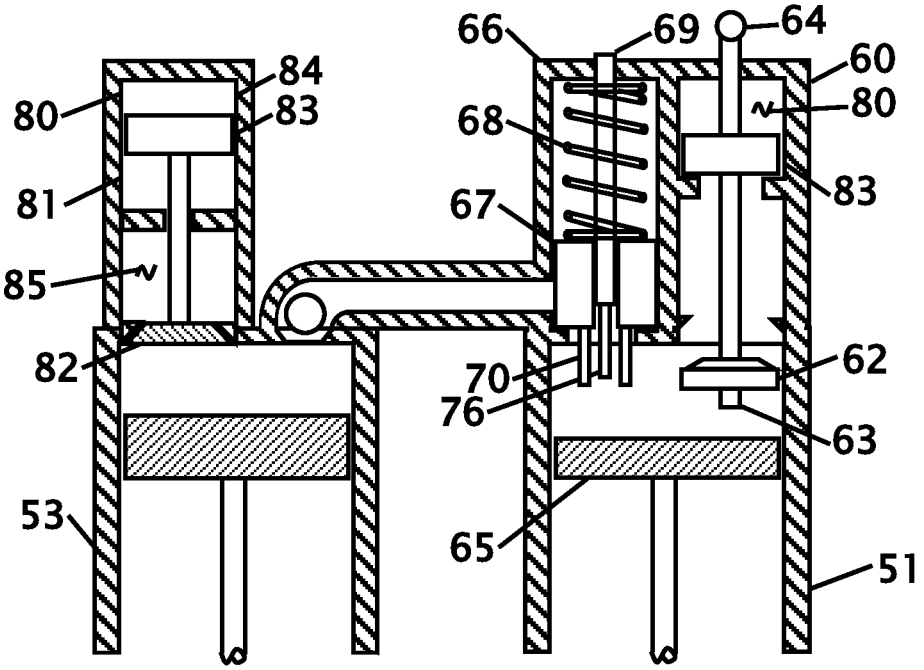

FIG. 28 shows a cross sectional view cut through 28-28 of FIG. 25.

FIG. 29*a* through FIG. 29*d* shows operation of the combustion cylinder with an exhaust valve, high pressure air and a fuel injector.

Figure 30A:
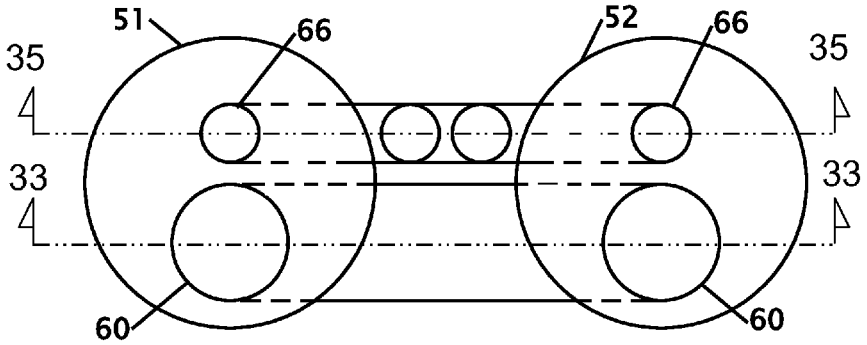

FIG. 30*a* shows a dual chamber cylinder upper chamber.

Figure 30B:
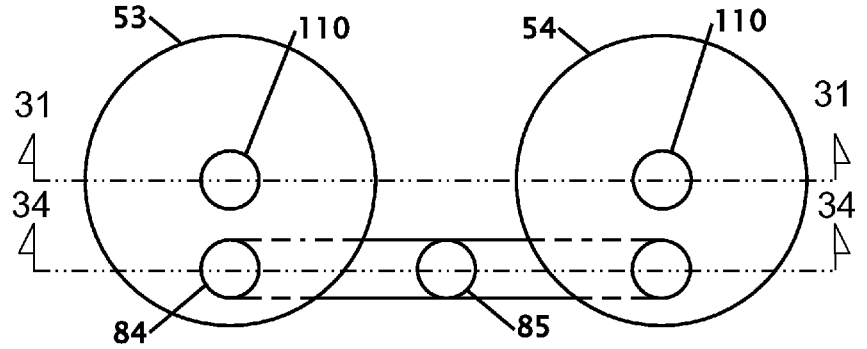

FIG. 30*b* shows a dual chamber cylinder lower chamber.

Figure 30C:
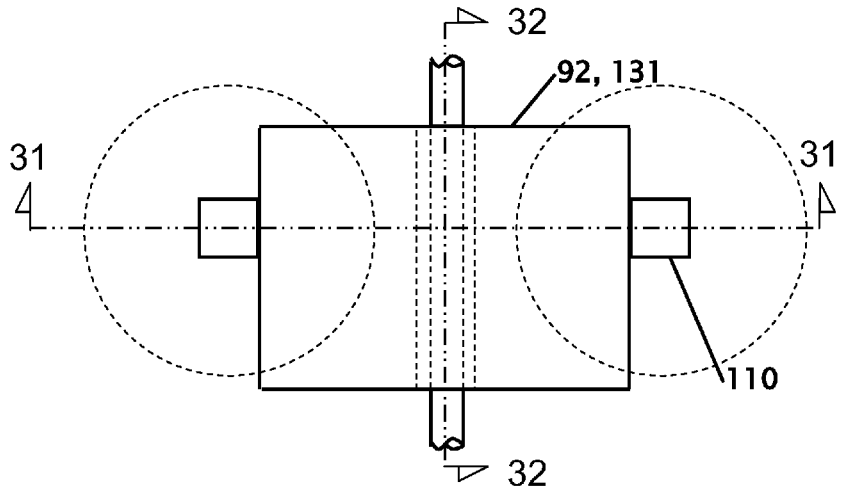

FIG. 30*c* shows a pair of one-way clutches for a dual chamber combustion engine.

Figure 31:
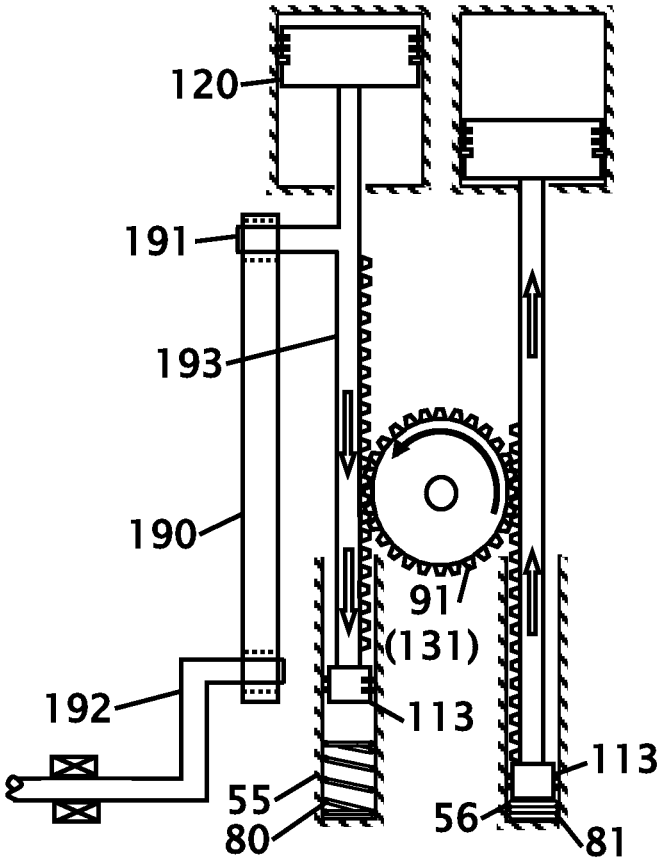

FIG. 31 shows a cross sectional view cut through 31-31 of FIGS. 30*b* and 31*c*.

Figure 32:
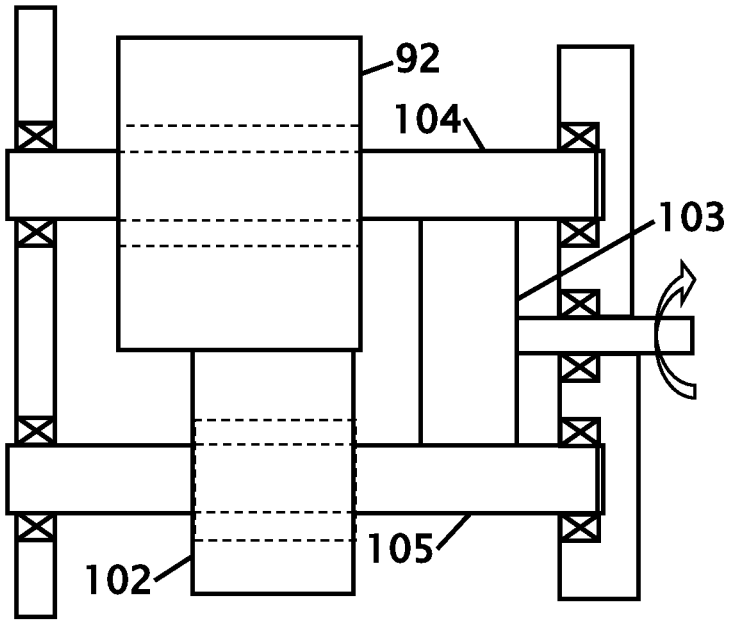

FIG. 32 shows a cross sectional view cut through 32-32 of FIG. 30*c*, pair of one-way clutches.

Figure 33:
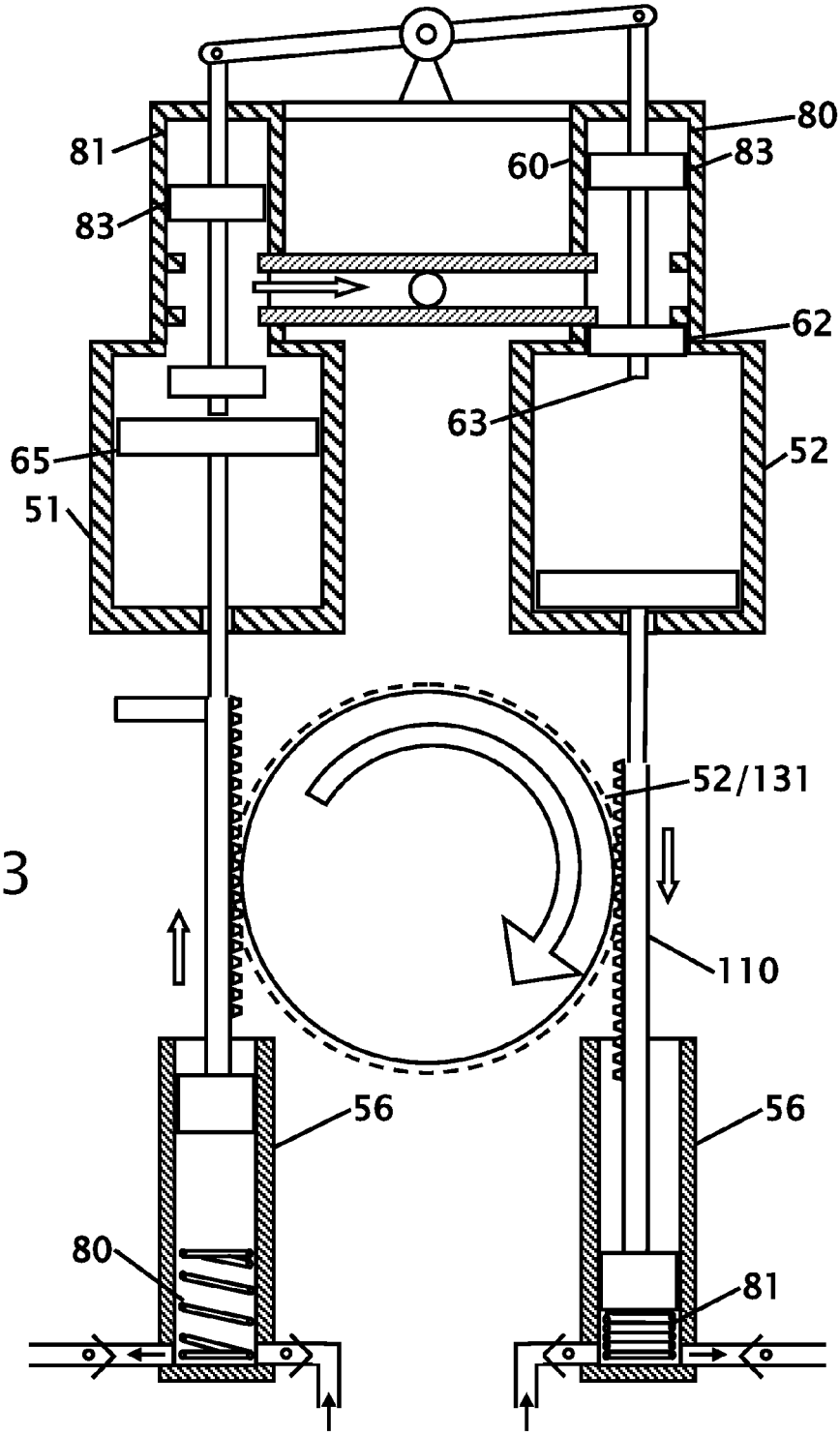

FIG. 33 shows a cross sectional view cut through 33-33 of FIG. 30*a*, exhaust valve.

Figure 34:
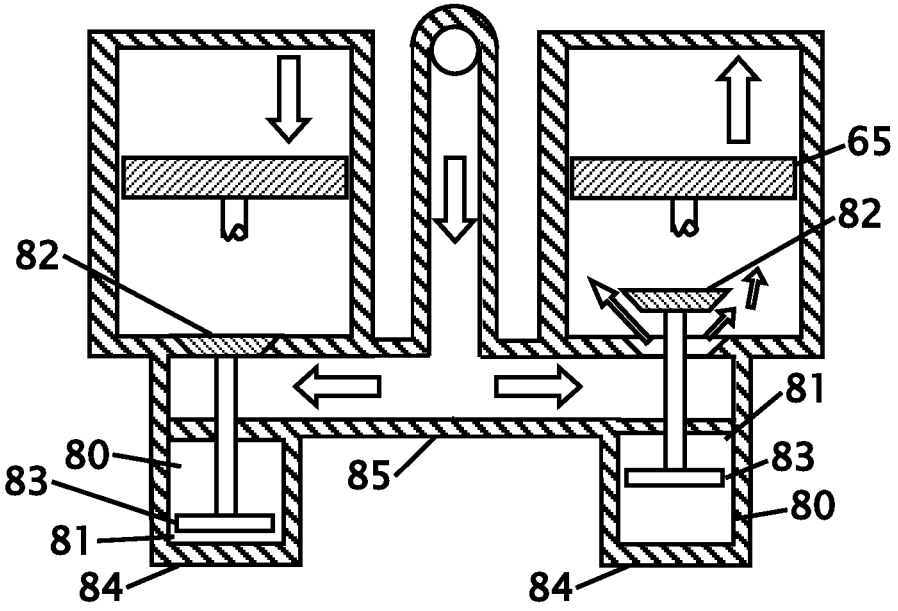

FIG. 34 shows a cross sectional view cut through 34-34 of FIG. 30*b*, air intake valve.

Figure 35:
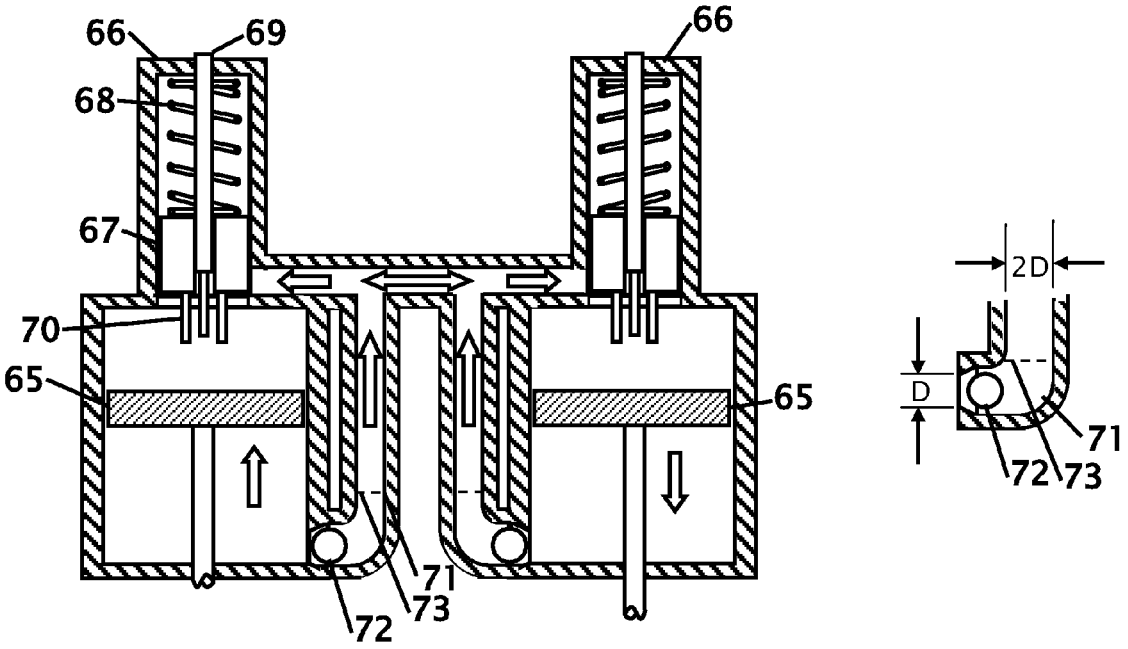

FIG. 35 shows a cross sectional view cut through 35-35 of FIG. 30*a*, high pressure air inlet.

Figure 36:
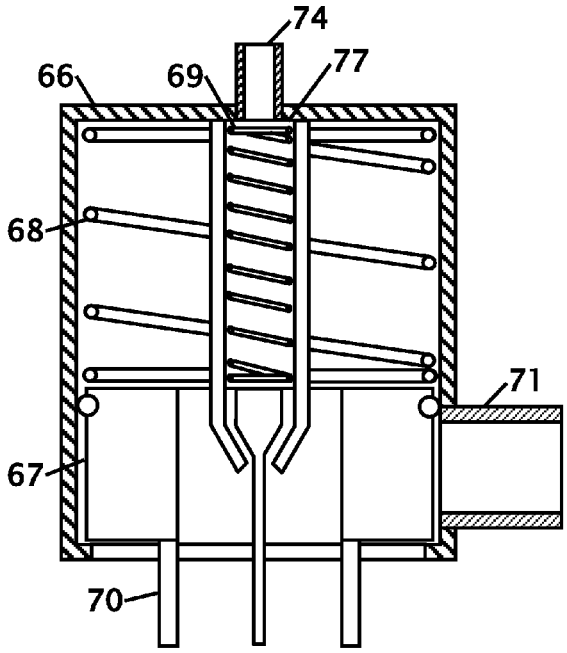

FIG. 36 shows a cross section of a high pressure inlet valve with a fuel injector.

Figure 36A:
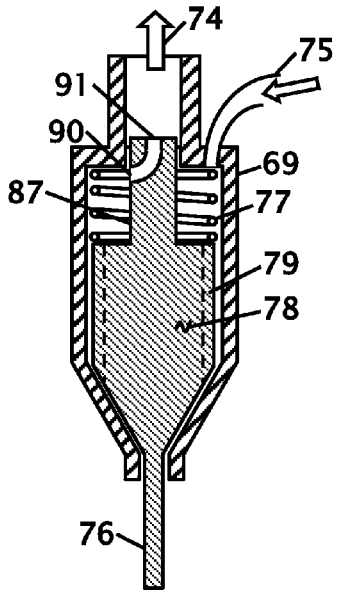

FIG. 36*a* shows a cross section of a fuel injector in a closed position.

Figure 36B:
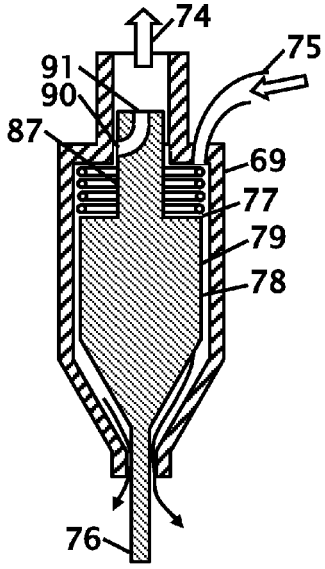

FIG. 36*b* shows a cross section of a fuel injector in an open position.

DETAILED DESCRIPTION OF THE INVENTION

Figure 1:
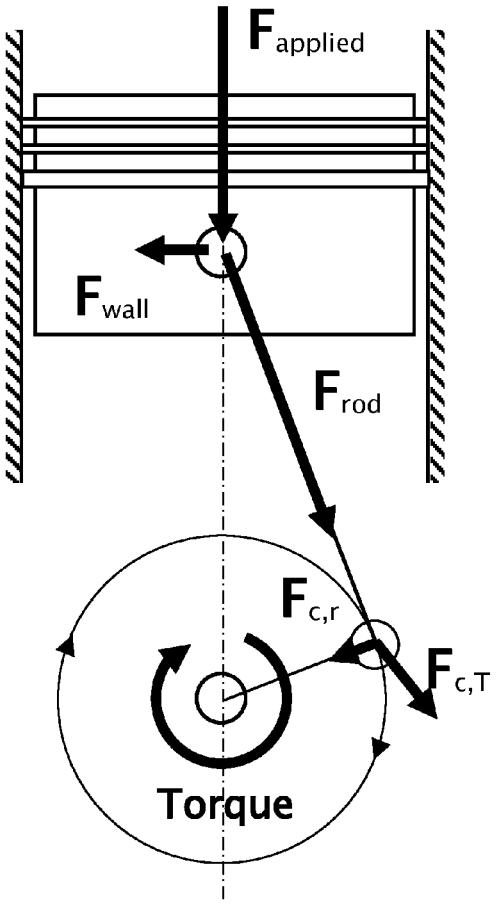
FIG. 1 shows the dynamic of the crank mechanism.

FIG. 1 shows the dynamic of the crank mechanism. Knowing the kinematics, a dynamical analysis of the piston/crank mechanism can be made. This figure shows the force acting on various components, as a result of an applied force on the piston. The resulting force on the piston can be divided into wall force, $F_{wall}$ creating friction force and rod force or crankshaft force and that can be divided into a radial Fe,r and a tangential force Fe,t. Only the tangential part will result in a crankshaft torque and useful force.

Figure 2:
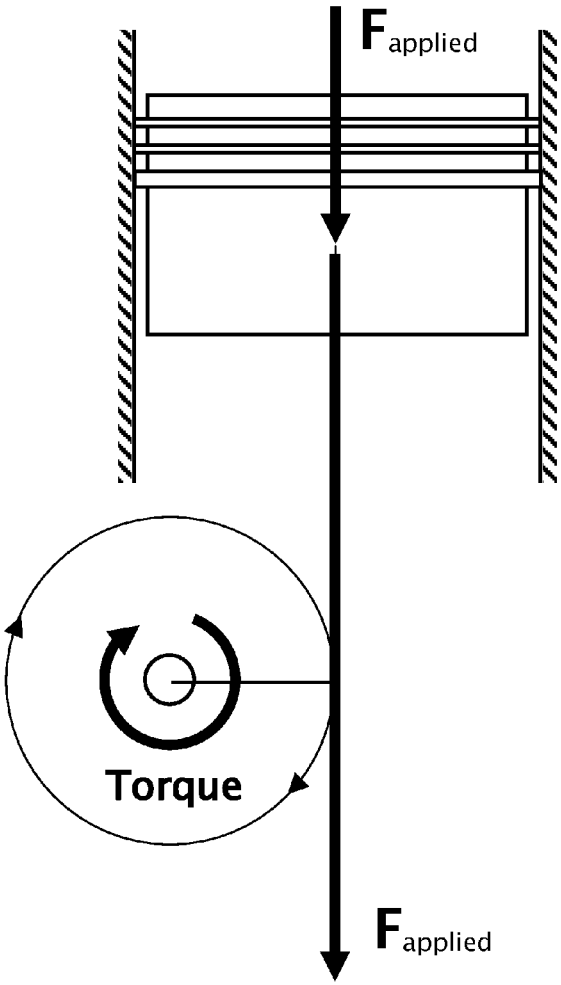
FIG. 2 shows the dynamic of a gear shaft or a pair of one-way clutches in the piston gear rod.

FIG. 2 shows the dynamic of gear shaft or a pair of one-way clutches in the piston gear rod. Knowing the kinematics, a dynamic analysis of the piston gear rod and output shaft can be made. The figure shows the force applied on the piston can be transfer nearly 100% to the output shaft with no friction Fn or any radial part force Fe,r.

Figure 3:
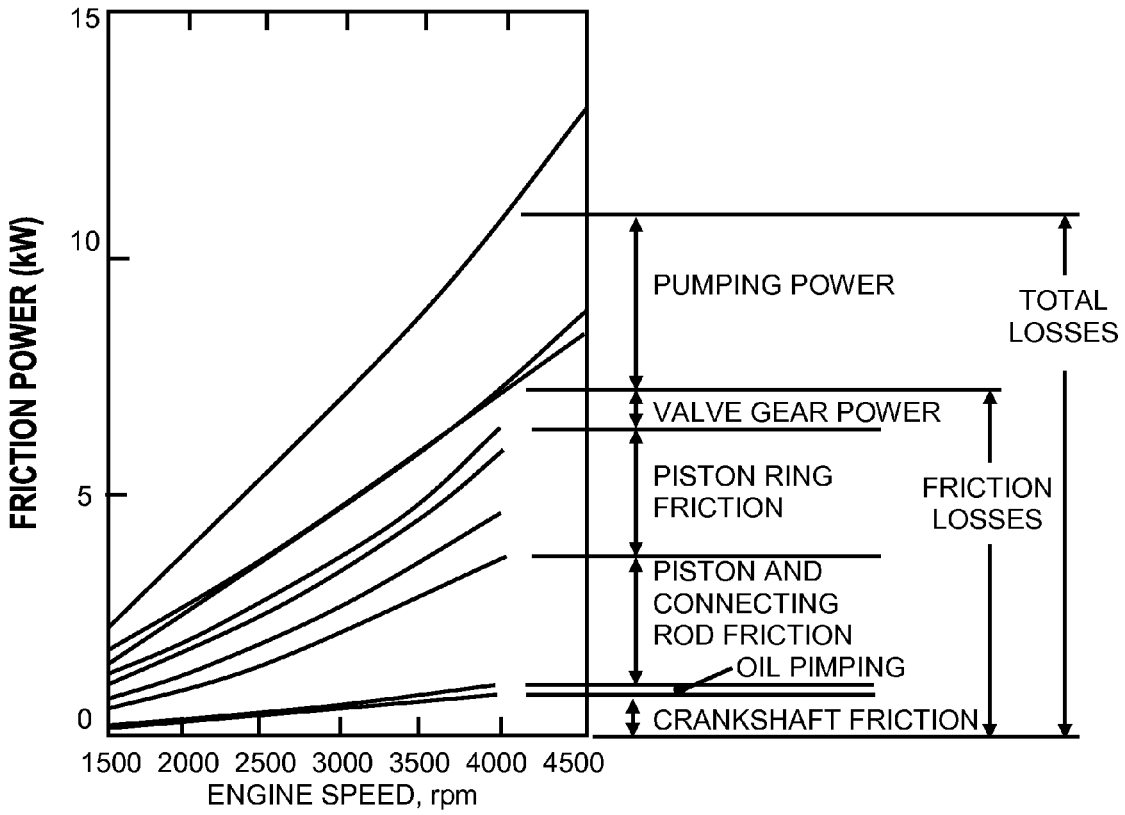
FIG. 3 shows the friction of the engine using the crankshaft.

FIG. 3 shows the engine using the crankshaft. The friction power loss is different at different engine speeds and where most of the power lost occurs in piston ring, connecting rod and crankshaft functions where this can be eliminated in the proposed disclosure.

Figure 4:
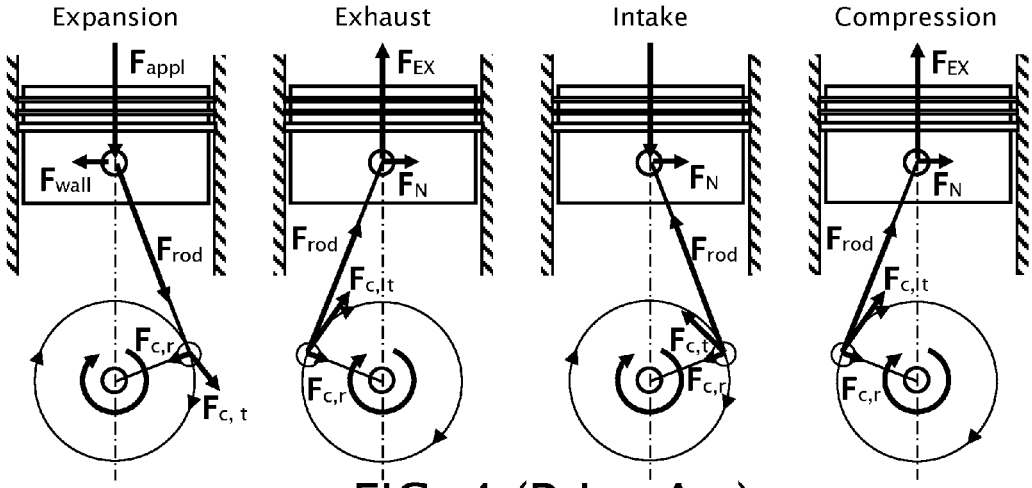
FIG. 4 (Prior Art)
FIG. 4 shows a conventional four stroke engine using a crankshaft.

FIG. 4 shows a conventional four stroke engine using a crankshaft where side walls create friction between the piston and the cylinder walls.

Figure 5:
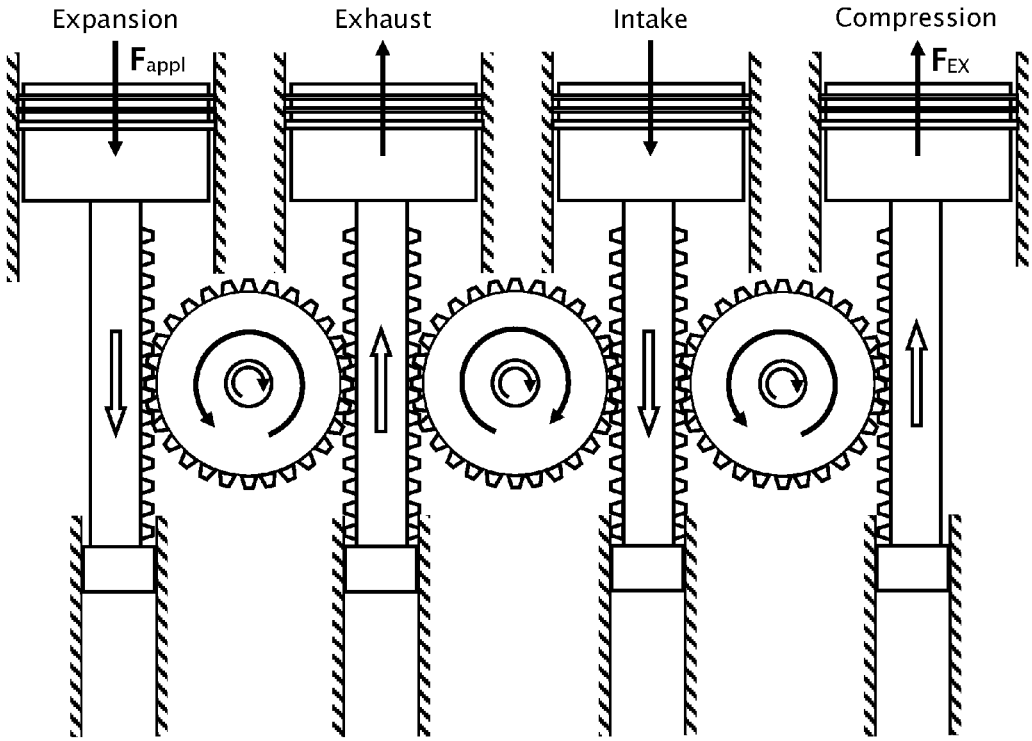
FIG. 5 shows the new proposed engine using a gear shaft.

FIG. 5 shows the proposed engine using a gear shaft between the piston gear rod where nearly 100% of the piston power is transferred to the output shaft.

A pair of one-way clutches is shown in FIGS. 6, 7*a*, 7*b* and 7*c*. The first one-way clutch 92 is connected to four piston gear rods 110. The second one-way clutch 102 is connected directly to the first one-way clutch 92. When the first clutch 92 moves to the left side then the clutch will move free and not be locked to the gear shaft 104 but the clutch 102 will move to the right side and will lock to gear shaft 105 and then to gear shaft 103. When the first clutch 92 moves to the right side then the clutch will lock to the output shaft 104 and the gear shaft 103. Flywheel 40 will smooth variations in rotational acceleration (s). The one-way clutch 102 will move to the left side and will be free and not lock. The one-way clutch 102 is driven in the reverse direction of the first one-way clutch 92

FIG. 8 shows combustion cylinder 108 where the combustion piston 109 moves linearly inside of the combustion cylinder 108. The hydraulic cylinder 112 where the hydraulic piston 113 moves linearly inside of the hydraulic cylinder. The hydraulic piston has a one-way valve 114 (shown in FIG. 9) to allow the high pressure oil to plunge from hydraulic cylinder to combustion piston 109 through a channel 111 on the piston gear rod 110. The hydraulic cylinder has a spring 115 for soft landing on the pistons 113 and for absorbing some power and reusing the power from return spring 115. The hydraulic cylinder 112 includes one outlet valve with a one-way valve to plunge high pressure oil to the radiator to intercool the oil and further includes one inlet valve with a check valve 116 to allow the low pressure oil to feed the hydraulic cylinder 112. The high pressure oil after cooling is sent to the other hydraulic cylinders at low pressure 112.

FIG. 10*a* shows a detail view of a four cycle engine cylinder and split cycle engine cylinder 121 where the high pressure oil pushes through the body of the piston 120 and discharges out of the piston 120.

FIG. 10*b* shows a detail for the dual chamber cylinder 121 where the high pressure oil 111 pushes through the body of the piston 120 and discharges through outlet channel 119 to out of the piston through a piston gear 110.

FIG. 11 shows a four cylinder engine where the engine comprises of four combustion units. Each combustion unit compressing one combustion cylinder 108 and one hydraulic cylinder 132. The four combustion cylinders are connected to each other with one-way clutches 92 through four piston gear rods 110. The one-way clutch 92 is connected other with one-way clutches 102. The pair of one-way clutches is connected to output shafts 103 through an output gear 104 and output gear 105. Flywheel 40 will smooth variations in rotational acceleration(s). The FIGS. 11, 12, 13, 14 and 15 show a small wing gear crankshaft 130 where the crankshaft gear rod 138 moves up and down through hydraulic cylinder 132 and is connected with one-way clutch 102. The gear rod 138 maintains up and down movement through rail 134 through a wing gear shaft 130 and the wing gear shaft has two bearings 135. The connecting rod 133 that is connected to main gear 136. The crankshaft is used for the operation of the camshaft (not shown) and operates to start the engine. The crankshaft gear 138 has an oil channel 111 from hydraulic piston 113 to lubricate the crankshaft bearing 135 and other engine bearings.

FIGS. 16 and 17 shows an embodiment of a four cylinder engine similar to the engine described in FIGS. 11, 12, 13, 14 and 15 except they do not use a pair of one-way clutches. In this embodiment the use only a gear shaft between the piston gear rod 110 and the crankshaft 136 and is used as a main shaft for the engine. The crankshaft is small and is less than one-quarter of the average mass of a crankshaft used in a conventional four-stroke engine of a similar displacement.

FIGS. 18 and 19 shows an eight cylinder engine with two combustion units where each unit has two opposed combustion cylinder. In this embodiment there are no hydraulic cylinders in the engine except for the crankshaft rod 138 that is operated by a pair of one-way clutches 92, 102 and one gear shaft 103 as previously described using the crankshaft for operation of a camshaft.

FIGS. 20 and 21 show a similar embodiment as shown in FIGS. 18 and 19 except this embodiment uses two gear shafts and crankshafts instead of a pair of one-way clutches as a main output shaft.

This embodiment uses only a gear shaft as shown in FIGS. 22, 23 and 24 that shows a four cylinder engine with two combustion units where each unit has two opposed combustion cylinders. In this embodiment there are no hydraulic cylinders in the engine except for crankshaft rod 138. The engine has only one gear shaft 131 connected to all piston rods 110 with crankshaft rod 138. The crankshaft is small and less than one-quarter of the mass of an average crankshaft used in a conventional four stroke engine if a similar displacement.

Split Cycle Engine

FIGS. 25, 26, 27 and 28 shows a split cycle combustion engine with two combustion units and two compressor units. The combustion unit has a combustion cylinder 51 and 52 and a hydraulic cylinder 55 and 56. The compressor unit has compressor cylinders 53 and 54 and hydraulic cylinder 55 and 56. In FIG. 26 the combustion cylinder has exhaust valve 60. The two exhaust cylinder valves are connected to each other with a swing arm 64. The valve is operated by oil pressure 80 and 82 from hydraulic cylinders 55 and 56. The valve will be closed in a first step by combustion piston pressure on valve stem 64 and a second step by pressure differential on the piston valve 83 and by swing arm 64.

FIG. 27 shows the compressor unit where each unit has one compressor cylinder 53 and 54 and one hydraulic cylinder 55 and 56. The compressor cylinder has an air intake valve 84. The valve opens and closes by differential pressure on the piston valve 83 and by oil pressure 80, 81 from the hydraulic cylinders 55 and 56.

FIG. 28 shows the high pressure air valve 66 that has cylinder 67 where the cylinder has an opening in the middle for fuel injector 69 and to allow pressure air balance on piston 67. The valve will be closed all the time by spring 68 and will be open by pressing the combustion piston on the stem cylinder valve 70 and closed again by spring 68. The fuel injector opens by pressing the combustion piston 65 on the stem of the fuel injector 76 to allow the fuel to be mixed with high pressure air at the same time as shown in the detail view of the fuel injector in FIGS. 36 and 37. The high pressure air will pass through a pipe 71 and ball check valve 72 to air valve 66.

The two compressor units and two combustion units are connected to each other by gear shaft 50 or one-way clutch 57 and operate opposed to each other where one compression piston moves up while the other compression piston moves down and vice versa. The power output for the engine is using a pair of one-way clutched 57 and or a small crankshaft as previously shown and described in the four cycle engine. As a second embodiment the power output for the engine is using a gear shaft between a piston gear rod 50 and with a small crankshaft as previously disclosed in the four cycle engine.

FIG. 29 shows the combustion cylinder 51 and 52 and the compression cylinder 53 and 54 in operation. The piston of the compression piston will be larger in height than the combustion piston and by Vc different, the Vc space between the highest combustion piston position can reach the top combustion cylinder.

Figure 29A:
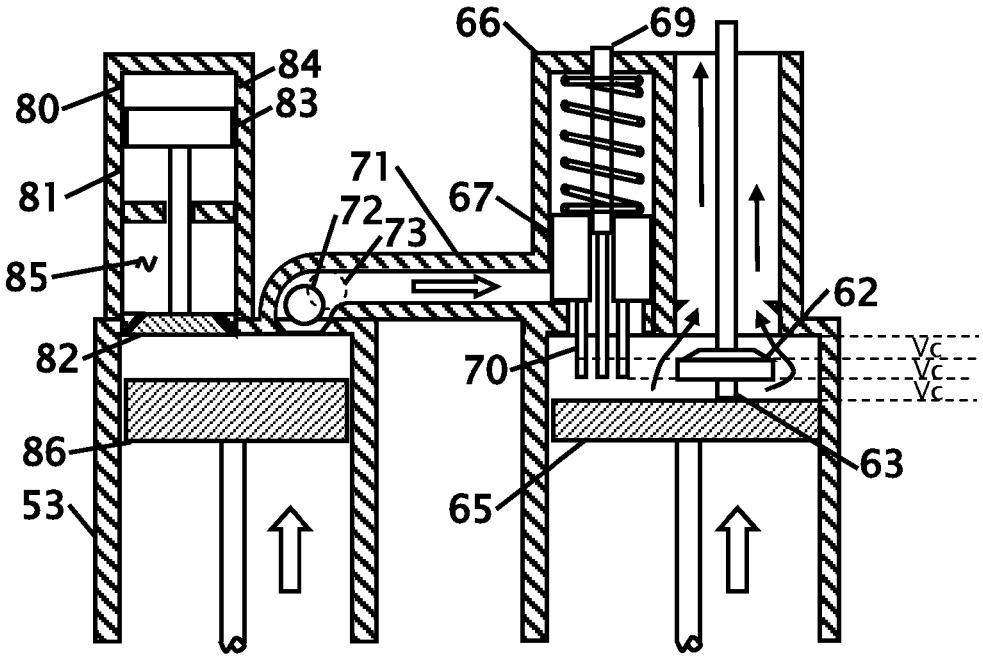

FIG. 29*a* shows the combination piston 65 moves up with the exhaust valve 62 open thereby allowing the exhaust gas to escape to outside of the cylinder. The compression piston 86 will compress air in the compression cylinder in the same time the valve 72, the valve 66 and the valve 82 will be closed.

Figure 29B:
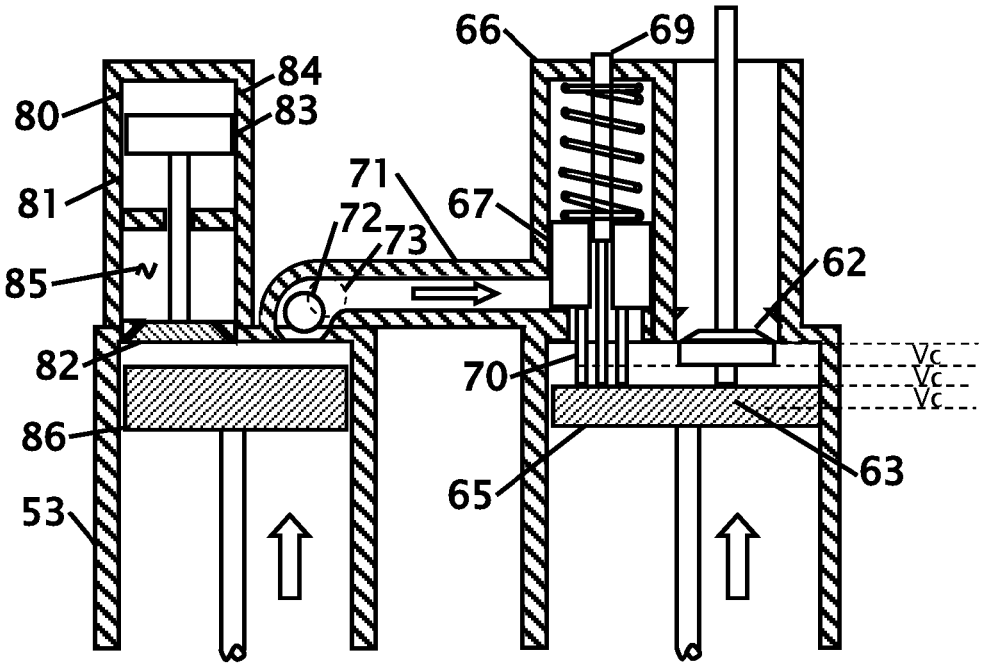

In FIG. 29*b* the combustion piston 65 and the compressor piston 86 will move up by Vc then the exhaust valve 62 will be closed by pressing the combustion piston 65 on the stem of the exhaust valve 63. The second combustion cylinder of the exhaust valve will stay closed. The ball valve in the compressor cylinder starts to open but the high pressure air valve 66 will be closed.

Figure 29C:
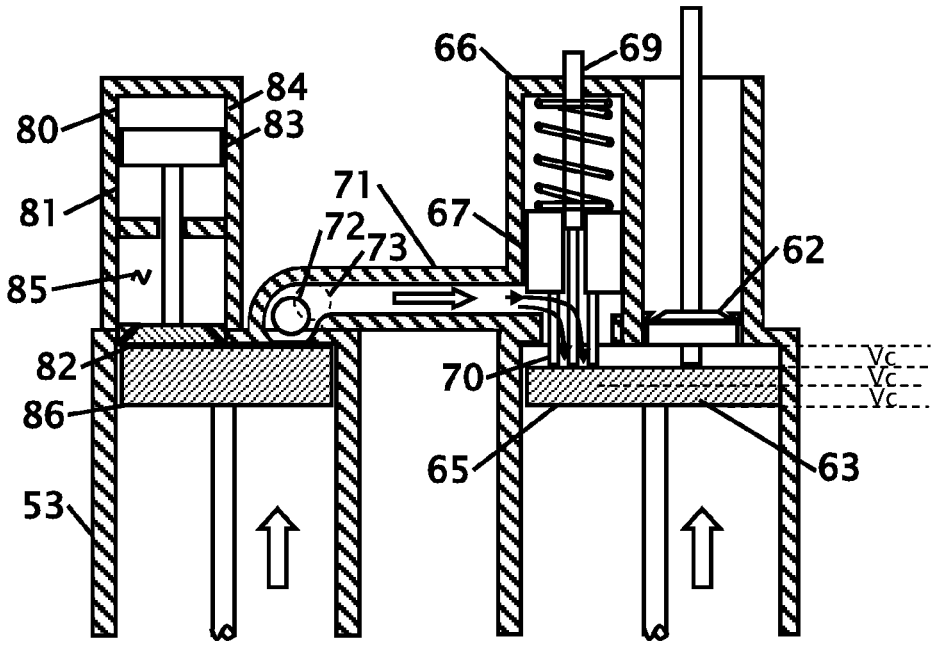

In FIG. 29*c* the combustion piston 65 moves up by second Vc and the compressor piston 86 moves and reaches top dead center TDC. The exhaust valve 62 will be closed but the exhaust valve 62 in the second combustion cylinder will be open. The high pressure air valve will be opened by pressing the piston 65 on the stem of piston valve 70. This allows the high pressure air to enter the combustion cylinder Vc space and will stay open until the combustion piston moves down by Vc. The fuel injector will be open by pressing on the stem of the fuel injector 76.

Figure 29D:
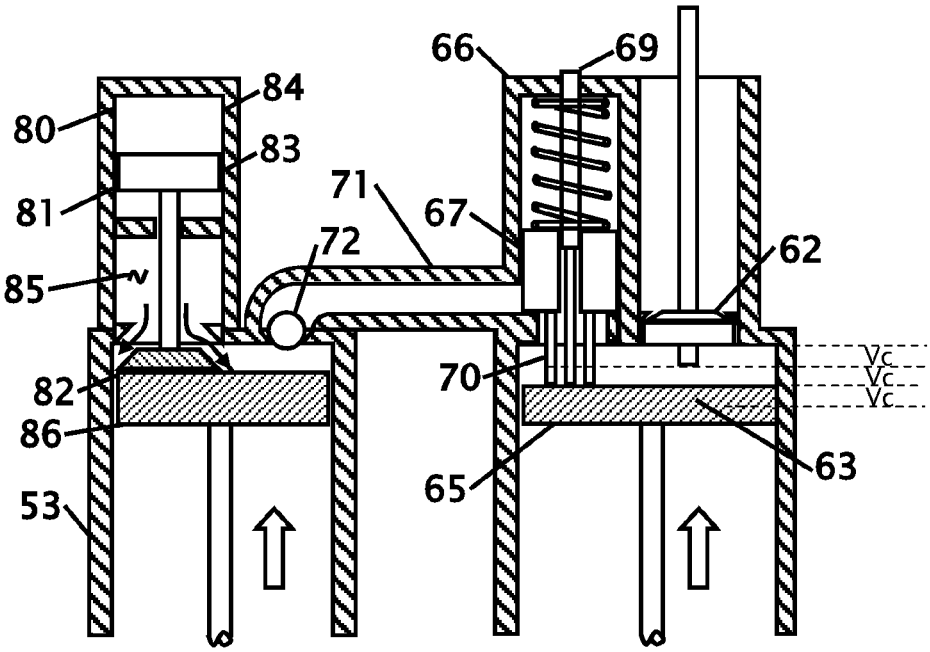

FIG. 29*d* shows the combustion piston 65 moves down by Vc and compressor piston 86 moves down by Vc then the high pressure air valve will be closed. The ball valve 72 will be closed and the fuel injector will be closed and the spark plug will fire and start the combustion cycle. The exhaust valve 62 will be closed in the compressor cylinder. The air inlet valve 82 will then open to allow the air into the compressor cylinder.

FIGS. 30*a*, 30*b*, 30*c* and 31 shows a dual chamber cylinder combustion engine where the upper cylinder is used as a combustion chamber and the lower chamber cylinder is used as a compressor chamber. The two chambers work as a split cycle engine as previously disclosed. FIG. 30*a* shows an upper chamber 51, 52 with high pressure air valve 66 and exhaust valve 60. In FIG. 30*b* the lower chamber has an intake air valve 84 and piston gear rod 110. FIG. 30*c* shows a two piston gear rod 110 connected to a pair of one-way clutches 92 or to a gear shaft 131.

FIG. 31 shows a cross sectional view cut through a-a of FIGS. 30*b*, and 30*c*. The piston gear rod 193 is divided into two sections where the upper section is round and the lower section is a gear type. The upper section of the gear rod 191 transfers power to the connecting rod 190 and to the crankshaft 192. The piston gear rod 193 has two oil channels, where one channel supplies high pressure oil 111 to the piston body 120 and the other channel is for return of the oil 119, as shown and described with FIG. 10*b*.

FIGS. 32, 7*a* and 7*c* show a cross-sectional view cut for a pair of one-way clutches 92, 102 or by a gear shaft 131 and then to a small crank shaft 192. The lower cylinder is used as a hydraulic cylinder to provide high pressure oil that is used in the upper cylinder 120 for intercooling the piston and intercooling the combustion walls and for lubricating the piston ring(s). Part of the oil is also used for lubrication of the crankshaft, bearings and other engine bearings.

FIG. 33 shows an exhaust valve 60 with a swing arm 64 as previously shown and described in the split cycle engine in FIG. 26.

FIG. 34 shows a cross section view for the lower chamber and for intake air valve 84. The valve opens and closes by differential pressure of hydraulic oil 80 and 81 on the piston valve 83 and hydraulic pressure provided by hydraulic cylinders 55 and 56. The air valve is shown as a second contemplated embodiment and could be a one-way check valve.

FIG. 35 shows a cross sectional view of the high pressure air supply to the upper chamber 66 with fuel injector 69. The lower chamber shows a ball check valve 72 that allows the air to flow in a direction from the lower chamber to the upper chamber. Operation of the high pressure air valve 66 and the injector 69 has been previously shown and described in the split cycle engine in FIGS. 27, 29*a*, 29*b*, 29*c* and 29*d*.

FIG. 36 shows a cross sectional view of a high pressure inlet valve 66 with a fuel injector 69. The valve has a piston stopper 67 that maintains the valve in a closed orientation all of the time by spring 68 and is only opened when the combustion piston pushes against the stem of valve 70. The piston has a hole that allows fuel injection 69 in between.

FIGS. 36*a* and 36*b* shows a cross-sectional view of a mechanical fuel injector 69. High pressure fuel enters through pipe 75 and unused fuel is returned to the fuel tank through pipe 74. The fuel injector comprises of a piston valve 78 that is held closed by spring 77 and the oil returns through pipe 74. The injector opens when the combustion cylinder piston presses on the stem 76 and one piston valve 79 to allow the fuel injection into the combustion chamber.

FIG. 36*a* shows the injector closed and high pressure fuel being returned to the fuel tank through outlet opening 90, 91 and 74. FIG. 36*b* shows the injector in an open condition allowing fuel injection into the combustion chamber. The outlet opening 90 is close and no fuel is returned to the fuel tank.

Thus, specific embodiments of a combustion engine with a pair of one-way clutches used as a rotary shaft have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A combustion engine with a pair of one-way clutches used as a rotary shaft comprising:

at least one pair of combustion units wherein each unit has at least two cylinders;

each unit has an upper cylinder and a lower cylinder;

said upper cylinder is used for a combustion process;

said lower cylinder is used as hydraulic pump;

a combustion piston is mounted inside each combustion cylinder for reciprocating linear motion with a hydraulic piston located in said hydraulic cylinders;

said combustion piston and said hydraulic piston are connected together with a fixed piston gear rod as one unit;

said piston gear rod has at least one one-way channel wherein an high pressure oil from said hydraulic piston is connected to said combustion piston body to intercool said combustion piston, a combustion cylinder wall and to lubricate at least one piston ring;

high pressure oil is sent to a radiator for cooling said oil;

said at least one pair of combustion units are connected to each other with a gear shaft or one-way clutch through said piston gear rod to allow said at least one pair of combustion units to be driven in opposite directions to each other;

at least a pair of one-way clutches are connected with at least one gear shaft to transfer power from said piston gear rod to an output shaft of said combustion engine, and at least a crankshaft that is mechanically connected to said gear shaft through said connecting gear rod;

a flywheel rotationally driven by said crankshaft;

said crankshaft is used to operate said camshaft for intake and exhaust valves and for starting said combustion engine.

2. The combustion engine according to claim 1 wherein a majority of power generated by said combustion engine is extracted through at least said pair of one-way clutches and with at least one gear to transfer said power of said combustion engine to said output shaft, and further said combustion units are connected to each other with gear shaft through said piston gear rod.

3. The combustion engine according to claim 1 wherein said crankshaft is mechanically connected to said gear shaft through said crankshaft gear rod, and a flywheel that is rotationally driven by said crankshaft said crankshaft is used to operate a camshaft for operation of an air intake valve, exhaust valve and for starting said combustion engine;

said crankshaft is used to extract a majority of power that is generated by said combustion engine;

said combustion units are connected to each other with a gear shaft through said piston gear rod;

said crankshaft gear rod moves up and down through said hydraulic cylinder with a piston located in an end of said crankshaft gear rod;

said crankshaft gear rod has a channel to allow said high pressure oil to lubricate said crankshaft bearing, and said high pressure oil is used to lubricate engine bearings.

4. The combustion engine according to claim 1 wherein said intake valves and said exhaust valves can operate by an electro-hydraulic actuator for a cam less internal combustion engine.

5. The combustion engine according to claim 1 wherein said crankshaft is less than one-quarter of the average mass of a crankshaft used in a conventional engine of similar displacement;

a crankshaft assembly wherein said flywheel extracts some power to operate said crankshaft for rotational momentum of said flywheel to ensure completion of travel is said combustion pistons and for starting said combustion engine;

said crankshaft gear rod moves inside said hydraulic cylinder with said hydraulic piston;

said crankshaft gear rod has an oil channel for lubricating crankshaft bearings and said engine bearings.

6. The combustion engine according to claim 1 wherein said hydraulic piston is driven in linear motion by said combustion piston;

ports in each of said hydraulic cylinders receive return oil through a one-way check valve;

a part of a high pressure oil is discharged through said one-way check valve in said hydraulic piston and through a channel in said piston gear rod to said combustion piston to intercool said pistons and to lubricate said piston rings;

at least a portion of said high pressure oil is discharged to said radiator for intercooling said oil;

at least a portion of said high pressure oil is used for hydraulic control for opening and closing of said intake and or said exhaust valve of said combustion engine;

said hydraulic cylinder also includes a spring in a top dead center for a soft landing of said piston and to absorb at least some power that is reused to return said piston.

7. The combustion engine according to claim 1 that further comprises at least one additional air compressor unit wherein each unit has two cylinders;

an upper cylinder that is used to compressor the air;

each compressor unit has an air inlet valve and an outlet air valve;

a lower cylinder that is used as a hydraulic pump;

a compressor piston respectively mounted in said compressor cylinder for reciprocating linear movement with a hydraulic piston located in a hydraulic cylinder;

said two pistons are connected to each other with a second piston gear rod;

said second piston rod gear has a second one-way channel wherein said oil plunged from said oil piston to said compressor piston body is used to intercool said piston and to lubricate said piston rings;

at least a part of said oil is sent to said radiator for intercooling said oil, and at least one said compressor unit is connected to each other and with a said combustion unit with said gear shaft through said piston rod gear.

8. The combustion engine according to claim 1 wherein said combustion engine operates as a four-cycle engine or a two-cycle engine or as a split cycle engine.

9. The combustion engine according to claim 8 wherein when said combustion engine is operating as a four-cycle engine, said combustion engine has at least four combustion units;

each of said four combustion units is connected to each other with a gear shaft through said piston gear rod therefore each cycle has two combustion pistons that move down when two combustion pistons move up;

power is extracted by a pair of one-way clutches and or said crankshaft and said flywheel;

said intake valves and said exhaust valves are operable by an electro-hydraulic actuator or by said camshaft that is connected to said crankshaft.

10. The combustion engine according to claim 8 wherein when said combustion engine is operating as a split-cycle engine, said combustion engine has at least two combustion units and at least two compressor units;

each of said at least two combustion units and said at least two compressor units is connected to each other with a gear shaft through said piston gear rod therefore each cycle has one combustion unit and one compressor unit that moves up as the other combustion unit and one compressor unit moves down;

said combustion unit comprises at least one fuel injector, one spark plug, one exhaust valve and one high pressure air inlet valve;

said compressor unit comprises at least one inlet valve and at least one high pressure air outlet check valve that is connected to said combustion cylinder;

power is extracted by a pair of one-way clutches as a rotary shaft and or by a crankshaft and flywheel.

11. The combustion engine according to claim 10 that further comprises at least one exhaust valve in each of said combustion cylinders where said at least one exhaust valve is operated by an exhaust hydraulic cylinder where piston movement occurs by pressing said combustion piston on a stem of said at least one exhaust valve and by pressure differential in said hydraulic cylinder of said combustion engine;

said two exhaust hydraulic pistons are connected to each other by a swing arm.

12. The combustion engine according to claim 10 that further comprises at least a piston air valve that allows high pressure air from said compressor cylinder to enter said combustion cylinder after closing said at least one exhaust valve;

said piston air valve further comprises at least a piston valve that is held closed by a spring and opens by said combustion piston pressing on said stem of said valve;

said valve in further includes at least one vent hole that allows equalization of pressure above and below said piston air valve, and said piston air valve has at least one hole that allows for fuel injector in between said piston valve.

13. The combustion engine according to claim 10 that further comprises at least one mechanical fuel injector wherein said mechanical fuel injector comprises at least one inlet high pressure fuel and at least one high pressure fuel outlet that returns to a fuel tank;

said mechanical fuel injector has a cone piston that is held closed by a spring and is opened by said combustion piston pressing on a stem of said cone piston after closing said exhaust valve.

14. The combustion engine according to claim 10 that further comprises at least one inlet valve in each of said compressor cylinder wherein said at least one inlet valve is operated by an inlet hydraulic cylinder by a pressure differential in said hydraulic cylinder of said combustion engine and at least one outlet valve has a one-way check valve that allows said high pressure air from said compressor cylinder into said combustion cylinder.

15. The combustion engine according to claim 10 wherein when said combustion engine is operating as a split-cycle engine with dual chamber cylinder where;

said engine comprises of at least two cylinder units;

said upper cylinder has two chambers, said upper chamber is for combustion cycle and said lower chamber is for a compression cycle;

said lower cylinder is used as a hydraulic cylinder;

said dual chamber piston is mounted in said cylinder for reciprocating linear motion with a hydraulic piston located in said hydraulic cylinder;

said two pistons are connected with each other with a fixed piston gear rod;

a piston gear rod where said piston gear rod has a one-way oil channel where oil is plunged from said hydraulic piston to a combustion piston ring body through a channel in said piston gear rod to intercool said piston, said combustion cylinder wall and to lubricate said piston ring;

said piston gear rod comprises of at least a second channel that allows return oil from said combustion piston ring body to discharge out of said upper cylinder;

at least a part of said oil is sent to said radiator for intercooling said oil;

said combustion engine further comprises at least a pair of two cylinder units connected to each other with a gear shaft through a piston gear rod to allow each cylinder unit to drive opposite directions with each other;

at least a pair of one-way clutched with a least one gear that transfers power from said piston gear rod to an output shaft of said combustion engine;

at least a crankshaft wherein said crankshaft is mechanically connected to said piston gear rod, and a flywheel that is rotationally driven by said crankshaft where said crankshaft is used for starting said combustion engine and to output power as a second option.

16. The combustion engine according to claim 15 further comprising at least one exhaust valve in each of said upper chamber said at least one exhaust valve is operated by exhaust hydraulic cylinder where said piston movement occurs by pressing said combustion piston on a valve stem of said at least one exhaust valve and by pressure differential of said hydraulic cylinder of said combustion engine;

said two exhaust hydraulic pistons are connected to each other by a swing arm;

said combustion chamber comprises a piston valve that allows high pressure air into said combustion chamber after closing said exhaust valves;

said piston valve is held closed by a spring and opens by pressure on a valve stem by said combustion piston, and said piston valve has a hole that allows fuel injection between said piston valve.

17. The combustion engine according to claim 15 further comprising at least one intake valve in each of said compressor chambers lower chamber wherein said at least one intake valve is operated by an intake hydraulic cylinder where said piston movement occurs by pressure differential in piston cylinders where hydraulic pressure is feed by hydraulic cylinder of said combustion engine, and said compressor chamber comprises at least one one-way check valve that allows high pressure air into said combustion chamber.

18. The combustion engine according to claim 15 that further comprises at least a piston air valve that allows high pressure air from said compressor chamber lower chamber to enter said combustion chamber upper chamber after closing said at least one exhaust valve;

said piston air valve further comprise at least a piston valve that is held closed by a spring and opened by said combustion piston pressing on a stem of said valve;

said valve further includes at least one vent hole that allows equalization of pressure above and below said air valve and said piston valve has at least one hole that allows for said mechanical fuel injector between said piston valve.

* * * * *